US008235102B1

(12) United States Patent
Robertson

(10) Patent No.: US 8,235,102 B1
(45) **Date of Patent: *Aug. 7, 2012**

(54) CONSUMABLE DOWNHOLE TOOL

(75) Inventor: Michael C. Robertson, Arlington, TX (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 257 days.

This patent is subject to a terminal disclaimer.

(21) Appl. No.: 12/190,892

(22) Filed: Aug. 13, 2008

Related U.S. Application Data

(63) Continuation-in-part of application No. 12/055,428, filed on Mar. 26, 2008, now Pat. No. 7,726,392.

(51) Int. Cl.
*E21B 29/02* (2006.01)

(52) U.S. Cl. ..... 166/63; 166/297

(58) Field of Classification Search ..... 166/58, 166/59, 63
See application file for complete search history.

(56) References Cited

U.S. PATENT DOCUMENTS

| | | | | |
|---|---|---|---|---|
| 2,037,938 | A | 4/1936 | Spencer | |
| 2,037,955 | A | 4/1936 | Wells | |
| 2,191,783 | A | 2/1940 | Wells | |
| 2,238,671 | A | 4/1941 | Woodhouse | |
| 2,571,636 | A | 10/1951 | Watkins | |
| 2,703,316 | A | 3/1955 | Schneider | |
| 2,958,512 | A | 11/1960 | Humphrey | |
| 3,029,872 | A | 4/1962 | Hanes | |
| 3,047,313 | A | 7/1962 | Bruce | |
| 3,057,295 | A | 10/1962 | Christopher | |
| 3,076,507 | A | 2/1963 | Sweetman | |
| RE25,453 | E | 10/1963 | Conrad | |
| 3,167,137 | A | 1/1965 | Humphrey | |
| 3,173,484 | A | 3/1965 | Huitt et al. | |
| 3,195,635 | A | 7/1965 | Fast | |
| 3,205,947 | A | 9/1965 | Parker | |
| 3,211,232 | A | 10/1965 | Grimmer | |
| 3,302,719 | A | 2/1967 | Fischer | |
| 3,364,995 | A | 1/1968 | Atkins et al. | |
| 3,366,178 | A | 1/1968 | Malone et al. | |
| 3,414,055 | A * | 12/1968 | Vogt, Jr. | 166/276 |

(Continued)

FOREIGN PATENT DOCUMENTS

EP 0 681 087 A2 11/1995

(Continued)

OTHER PUBLICATIONS

Skrabal, Anton, et al., "The hydrolysis rate of orthoformic acid ethyl ether", Chemical Institute of the University of Graz, Jan. 13, 1921, pp. 1-38+ cover.

(Continued)

*Primary Examiner* — Shane Bomar
*Assistant Examiner* — Kipp Wallace
(74) *Attorney, Agent, or Firm* — The Matthews Firm

(57) ABSTRACT

A torch apparatus for consuming a material having a fuel load that produces heat and a source of oxygen when burned, and a plurality of slots having interstitial spaces therebetween for allowing longitudinal flow of fluid along the torch apparatus without interfering with the flow of fluid through the slots. The slots are oriented such that the heat and source of oxygen are provided to a material that is at least partially consumed when exposed to heat and oxygen, to thereby cause destruction of an object containing the material or disengagement of the object such that it falls into the wellbore.

29 Claims, 12 Drawing Sheets

U.S. PATENT DOCUMENTS 3,455,390 A 7/1969 Galius
3,768,563 A 10/1973 Blount
3,784,585 A 1/1974 Schmitt et al.
3,828,854 A 8/1974 Templeton et al.
3,868,998 A 3/1975 Lybarger et al.
3,912,692 A 10/1975 Casey et al.
3,954,438 A 5/1976 Hunter et al.
3,954,788 A 5/1976 Hunter et al.
3,960,736 A 6/1976 Free et al.
3,968,840 A 7/1976 Tate
3,997,277 A 12/1976 Swisher, Jr. et al.
3,998,744 A 12/1976 Arnold et al.
4,023,494 A 5/1977 Barton et al.
4,068,718 A 1/1978 Cooke, Jr. et al.
4,089,035 A 5/1978 Smith
4,167,521 A 9/1979 Fowler et al.
4,169,798 A 10/1979 DeMartino
4,178,852 A 12/1979 Smith et al.
4,184,838 A 1/1980 Burns et al.
4,187,909 A 2/1980 Erbstoesser
4,278,127 A 7/1981 Rankin
4,282,034 A 8/1981 Smith et al.
4,295,424 A 10/1981 Smith et al.
4,334,579 A 6/1982 Gregg
4,351,082 A 9/1982 Ackerman et al.
4,352,397 A 10/1982 Christopher
4,387,769 A 6/1983 Erbstoesser et al.
4,417,989 A 11/1983 Hunter
4,424,263 A 1/1984 Howell et al.
4,428,430 A 1/1984 Terrell, I et al.
4,430,662 A 2/1984 Jillie, Jr. et al.
4,442,975 A 4/1984 Long et al.
4,446,920 A 5/1984 Woytek et al.
4,470,915 A 9/1984 Conway
4,498,228 A 2/1985 Jillie, Jr. et al.
4,501,757 A 2/1985 Smith et al.
4,526,695 A 7/1985 Erbstoesser et al.
4,527,605 A 7/1985 Ede et al.
4,536,414 A 8/1985 Kroger et al.
4,554,567 A 11/1985 Jillie et al.
4,559,708 A 12/1985 Duel et al.
4,593,350 A 6/1986 Mitchell et al.
4,598,769 A 7/1986 Robertson
4,613,394 A 9/1986 Terrell et al.
4,621,562 A 11/1986 Carr et al.
4,633,711 A 1/1987 Hipple et al.
4,655,632 A 4/1987 Smith
4,700,778 A 10/1987 Smith et al.
4,713,859 A 12/1987 Smith, Jr.
4,715,967 A 12/1987 Bellis et al.
4,716,964 A 1/1988 Erbstoesser et al.
4,743,257 A 5/1988 Tormala et al.
4,744,630 A 5/1988 Hipple et al.
4,754,417 A 6/1988 Beeson et al.
4,803,959 A 2/1989 Sherrick et al.
4,809,783 A 3/1989 Hollenbeck et al.
4,815,160 A 3/1989 Smith et al.
4,815,351 A 3/1989 Smith et al.
4,843,118 A 6/1989 Lai et al.
4,848,467 A 7/1989 Cantu et al.
4,889,187 A 12/1989 Terrell et al.
4,889,638 A 12/1989 Rockford et al.
4,908,904 A 3/1990 Smith, Jr.
4,957,165 A 9/1990 Cantu et al.
4,961,466 A 10/1990 Himes et al.
4,986,353 A 1/1991 Clark et al.
4,986,354 A 1/1991 Cantu et al.
4,986,355 A 1/1991 Casad et al.
4,995,758 A 2/1991 Smith
5,012,180 A 4/1991 Dalrymple et al.
5,025,412 A 6/1991 Dalrymple et al.
5,032,982 A 7/1991 Dalrymple et al.
5,070,823 A 12/1991 Ackerman et al.
5,082,056 A 1/1992 Tackett, Jr.
5,090,087 A 2/1992 Hipple et al.
D327,105 S 6/1992 Smith, Jr.
5,131,472 A 7/1992 Dees et al.
5,153,509 A 10/1992 Dalrymple et al.
5,193,199 A 3/1993 Dalrymple et al.
5,216,050 A 6/1993 Sinclair
5,220,673 A 6/1993 Dalrymple et al.
5,222,218 A 6/1993 Smith
5,224,540 A 7/1993 Streich et al.
5,248,217 A 9/1993 Smith
D340,412 S 10/1993 Smith
5,253,712 A 10/1993 Swor
5,261,488 A 11/1993 Gullet et al.
5,267,533 A 12/1993 Smith
5,271,468 A 12/1993 Streich et al.
5,271,675 A 12/1993 Fagan et al.
5,272,333 A 12/1993 Fagan et al.
5,294,469 A 3/1994 Suzuki et al.
5,309,299 A 5/1994 Crossland et al.
5,318,377 A 6/1994 Swisher, Jr. et al.
5,320,174 A 6/1994 Terrell et al.
5,326,969 A 7/1994 Fagan et al.
5,333,684 A 8/1994 Walter et al.
5,343,954 A 9/1994 Bohlen et al.
5,390,737 A 2/1995 Jacobi et al.
5,404,956 A 4/1995 Bohlen et al.
5,405,212 A 4/1995 Swisher, Jr. et al.
5,435,394 A 7/1995 Robertson
5,439,055 A 8/1995 Card et al.
5,439,059 A 8/1995 Harris et al.
5,440,917 A 8/1995 Smith et al.
5,460,226 A 10/1995 Lawson et al.
5,479,986 A 1/1996 Gano et al.
5,488,224 A 1/1996 Fagan et al.
5,509,480 A 4/1996 Terrell et al.
5,513,570 A 5/1996 Mulcahy
5,540,279 A 7/1996 Branch et al.
5,540,293 A 7/1996 Mohaupt
5,569,286 A 10/1996 Peckham et al.
5,575,331 A 11/1996 Terrell
5,588,907 A 12/1996 DePietro et al.
5,591,700 A 1/1997 Harris et al.
5,607,017 A 3/1997 Owens et al.
5,607,905 A 3/1997 Dobson, Jr. et al.
5,636,692 A 6/1997 Haugen
D381,024 S 7/1997 Hinzmann et al.
5,685,372 A 11/1997 Gano
5,689,085 A 11/1997 Turner
5,690,171 A 11/1997 Winch et al.
D387,865 S 12/1997 Peckham et al.
5,698,322 A 12/1997 Tsai et al.
5,698,814 A 12/1997 Parsons et al.
5,701,959 A 12/1997 Hushbeck et al.
5,709,265 A 1/1998 Haugen et al.
5,713,621 A 2/1998 Krenkel et al.
5,720,344 A 2/1998 Newman
5,720,824 A 2/1998 Bronson et al.
5,740,234 A 4/1998 Black et al.
5,760,250 A 6/1998 Jones et al.
5,763,021 A 6/1998 Young et al.
5,765,641 A 6/1998 Shy et al.
5,791,417 A 8/1998 Haugen et al.
5,829,200 A 11/1998 Jones et al.
5,839,515 A 11/1998 Yuan et al.
5,847,138 A 12/1998 Jones et al.
5,849,401 A 12/1998 El-Afandi et al.
D412,062 S 7/1999 Potter et al.
5,984,007 A 11/1999 Yuan et al.
5,984,573 A 11/1999 Smith
5,990,051 A 11/1999 Ischy et al.
6,016,753 A 1/2000 Glenn et al.
6,021,457 A 2/2000 Archer et al.
6,024,169 A * 2/2000 Haugen ..... 166/298
6,045,420 A 4/2000 Small et al.
6,061,507 A 5/2000 Fitzgerald et al.
6,065,540 A 5/2000 Thomeer et al.
6,102,117 A 8/2000 Swor et al.
6,110,875 A 8/2000 Tjon-Joe-Pin et al.
6,131,661 A 10/2000 Conner et al.
6,135,987 A 10/2000 Tsai et al.
6,143,698 A 11/2000 Murphey et al.
6,161,622 A 12/2000 Robb et al.
6,162,766 A 12/2000 Muir et al.

| | | | |
|---|---|---|---|
| 6,167,127 | A | 12/2000 | Smith et al. |
| 6,175,490 | B1 | 1/2001 | Papa et al. |
| 6,186,226 | B1 | 2/2001 | Robertson |
| 6,189,615 | B1 | 2/2001 | Sydansk |
| 6,191,032 | B1 | 2/2001 | Tiffin et al. |
| 6,195,717 | B1 | 2/2001 | Henderson et al. |
| 6,209,646 | B1 | 4/2001 | Reddy et al. |
| 6,218,343 | B1 | 4/2001 | Burts, Jr. |
| 6,220,349 | B1 | 4/2001 | Vargus et al. |
| 6,242,390 | B1 | 6/2001 | Mitchell et al. |
| 6,249,834 | B1 | 6/2001 | Henderson et al. |
| 6,253,334 | B1 | 6/2001 | Amdahl et al. |
| 6,287,672 | B1 | 9/2001 | Fields et al. |
| 6,318,460 | B1 | 11/2001 | Swor et al. |
| 6,323,307 | B1 | 11/2001 | Bigg et al. |
| 6,324,608 | B1 | 11/2001 | Papa et al. |
| 6,328,105 | B1 | 12/2001 | Betzold |
| 6,357,396 | B1 | 3/2002 | Stansfield et al. |
| 6,375,275 | B1 | 4/2002 | Smith, Jr. et al. |
| 6,376,524 | B1 | 4/2002 | Barr et al. |
| 6,378,606 | B1 | 4/2002 | Swor et al. |
| 6,387,986 | B1 | 5/2002 | Moradi-Araghi et al. |
| 6,394,180 | B1 | 5/2002 | Berscheidt et al. |
| 6,394,185 | B1 | 5/2002 | Constien |
| 6,415,712 | B1 | 7/2002 | Helland et al. |
| 6,422,314 | B1 | 7/2002 | Todd et al. |
| 6,443,538 | B1 | 9/2002 | Smith, Jr. et al. |
| 6,444,316 | B1 | 9/2002 | Reddy et al. |
| 6,460,378 | B1 | 10/2002 | Dong et al. |
| 6,470,835 | B1 | 10/2002 | Stansfield et al. |
| 6,481,497 | B2 | 11/2002 | Swor et al. |
| 6,491,116 | B2 | 12/2002 | Berscheidt et al. |
| 6,494,263 | B2 | 12/2002 | Todd |
| 6,527,051 | B1 | 3/2003 | Reddy et al. |
| D473,517 | S | 4/2003 | Overthun et al. |
| 6,554,071 | B1 | 4/2003 | Reddy et al. |
| 6,561,270 | B1 | 5/2003 | Budde |
| 6,565,955 | B2 | 5/2003 | Fields et al. |
| 6,584,336 | B1 | 6/2003 | Ali et al. |
| 6,598,679 | B2 | 7/2003 | Robertson |
| 6,599,863 | B1 | 7/2003 | Palmer et al. |
| D481,226 | S | 10/2003 | Overthun et al. |
| 6,633,933 | B1 | 10/2003 | Smith et al. |
| 6,640,700 | B2 | 11/2003 | Helland et al. |
| 6,655,459 | B2 | 12/2003 | Mackay |
| 6,666,266 | B2 | 12/2003 | Starr et al. |
| 6,666,275 | B2 | 12/2003 | Neal et al. |
| 6,667,279 | B1 | 12/2003 | Hessert et al. |
| 6,669,771 | B2 | 12/2003 | Tokiwa et al. |
| D485,096 | S | 1/2004 | Overthun et al. |
| 6,681,856 | B1 | 1/2004 | Chatterji et al. |
| 6,687,261 | B1 | 2/2004 | Skeba et al. |
| 6,695,050 | B2 | 2/2004 | Winslow et al. |
| 6,695,051 | B2 | 2/2004 | Smith et al. |
| 6,702,009 | B1 | 3/2004 | Drury et al. |
| 6,704,408 | B2 | 3/2004 | Smith et al. |
| 6,704,991 | B1 | 3/2004 | Coulborn et al. |
| 6,710,019 | B1 | 3/2004 | Sawdon et al. |
| 6,712,143 | B2 | 3/2004 | Robertson |
| 6,712,153 | B2 | 3/2004 | Turley et al. |
| 6,722,435 | B2 | 4/2004 | DeGeare |
| 6,742,069 | B2 | 5/2004 | Papa et al. |
| 6,761,174 | B2 | 7/2004 | Jupe et al. |
| 6,761,218 | B2 | 7/2004 | Nguyen et al. |
| 6,770,028 | B1 | 8/2004 | Ali et al. |
| 6,772,775 | B2 | 8/2004 | Ackerman et al. |
| 6,782,679 | B2 | 8/2004 | Helland et al. |
| 6,856,737 | B1 | 2/2005 | Parker et al. |
| 6,862,502 | B2 | 3/2005 | Peltz et al. |
| 6,898,097 | B2 | 5/2005 | Dugger et al. |
| 6,925,937 | B2 | 8/2005 | Robertson |
| 6,926,086 | B2 | 8/2005 | Patterson et al. |
| 6,954,252 | B1 | 10/2005 | Crossland et al. |
| 6,966,386 | B2 | 11/2005 | Ringgenberg et al. |
| 6,971,449 | B1 | 12/2005 | Robertson |
| 6,975,786 | B1 | 12/2005 | Warr et al. |
| 6,976,534 | B2 | 12/2005 | Sutton et al. |
| 6,997,252 | B2 | 2/2006 | Porter et al. |
| 7,013,599 | B2 | 3/2006 | Smith et al. |
| 7,027,146 | B1 | 4/2006 | Smith et al. |
| D520,355 | S | 5/2006 | Overthun et al. |
| 7,036,587 | B2 | 5/2006 | Munoz et al. |
| 7,044,230 | B2 | 5/2006 | Starr et al. |
| 7,048,066 | B2 | 5/2006 | Ringgenberg et al. |
| 7,055,094 | B2 | 5/2006 | Irnielinski et al. |
| 7,210,533 | B2 | 5/2007 | Starr et al. |
| 2001/0016562 | A1 | 8/2001 | Muir et al. |
| 2002/0036088 | A1 | 3/2002 | Todd |
| 2002/0125012 | A1 | 9/2002 | Dawson et al. |
| 2003/0024072 | A1 | 2/2003 | Nussbaum |
| 2003/0060374 | A1 | 3/2003 | Cooke, Jr. |
| 2003/0114314 | A1 | 6/2003 | Ballard et al. |
| 2003/0130133 | A1 | 7/2003 | Vollmer |
| 2003/0168214 | A1 | 9/2003 | Sollesnes |
| 2003/0183391 | A1 | 10/2003 | Hriscu et al. |
| 2003/0213601 | A1 | 11/2003 | Schwendemann et al. |
| 2003/0234103 | A1 | 12/2003 | Lee et al. |
| 2004/0014607 | A1 | 1/2004 | Sinclair et al. |
| 2004/0040706 | A1 | 3/2004 | Hossaini et al. |
| 2004/0089450 | A1 | 5/2004 | Slade et al. |
| 2004/0152601 | A1 | 8/2004 | Still |
| 2004/0231845 | A1 | 11/2004 | Cooke, Jr. |
| 2005/0006095 | A1 | 1/2005 | Justus et al. |
| 2005/0189104 | A1 | 9/2005 | Turley et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2005/0241824 | A1 | 11/2005 | Burris, II et al. |
| 2005/0241825 | A1 | 11/2005 | Burris, II et al. |
| 2005/0241835 | A1 | 11/2005 | Burris, II et al. |
| 2005/0269083 | A1 | 12/2005 | Burris, II et al. |
| 2006/0021748 | A1 | 2/2006 | Swor et al. |
| 2006/0048940 | A1 | 3/2006 | Hromas et al. |
| 2006/0131031 | A1 | 6/2006 | McKeachnie et al. |
| 2007/0284097 | A1 * | 12/2007 | Swor et al. ..... 166/59 |

FOREIGN PATENT DOCUMENTS

| | | | |
|---|---|---|---|
| WO | WO 00/57022 | | 9/2000 |
| WO | WO 01/02698 | A1 | 1/2001 |
| WO | WO 2004/007905 | A1 | 1/2004 |
| WO | WO 2004/037946 | A1 | 5/2004 |
| WO | WO 2004/038176 | A1 | 5/2004 |

OTHER PUBLICATIONS

Heller, Jorge et al, "Poly (Ortho Esters) for the Pulsed and Continuous Delivery of Peptides and Proteins", Controlled Release & Biomedical Polymers Department, SRI International, pp. 39-56.

Dechy-Cabaret, Odile et al. "Controlled Ring-Opening Polymerization of Lactide and Glycolide", American Chemical Society, Apr. 26, 2004, 30 pgs.

Ahmad, M. et al, "Ortho Ester Hydrolysis: Direct Evidence for a Three-Stage Reaction Mechanism", May 9, 1979, 1 pg.

Heller, J. et al, "Release of Norethindrone from Poly (Ortho Esters)", Polymer Engineering and Science, vol. 21, No. 11, mid-Aug. 1981, pp. 727-731.

Y. Chiang et al, "Hydrolysis of Ortho Esters: Further Investigation of the Factors which Control the Rate-Determining Step", University of Toronto, Department of Chemistry, Nov. 16, 1983, 1 pg.

Cantu, Lisa A. et al, "Laboratory and Field Evaluation of a Combined Fluid-Loss-Control Additive & Gel Breaker for Fracturing Fluids", Society of Petroleum Engineers, 1990, 10 pages.

Ng, S.Y. et al, "Synthesis and Erosion Studies of Self-Catalyzed Poly (orther esters)", Macromolecules, vol. 30, No. 4, American Chemical Society, 1997, pp. 770-772.

Zignani, M. et al, "Subconjunctival biocompatibility of a viscous boderodable poly (ortho ester)", John Wiley & Sons, Inc., 1998, pp. 277-285.

Yin, Mao et al, "Preparation and Characterization of Substituted Polylactides", Macromolecules, vol. 32, No. 23,American Chemical Society, Nov. 16, 1999, pp. 7711-7718.

Schwach-Abdellaoui, K. et al, "Hydrolysis & Erosion Studies of Autocatalyzed Poly (ortho esters) Containing Lactoyl-Lactyl Acid Dimers", Macromolecules, vol. 32, No. 2, American Chemical Society, 1999, pp. 301-307.

Ng, S.Y. et al, "Development of a poly (ortho ester) prototype with a latent acid in the polymer backbone for 5-fluorouracll delivery", Journal of Controlled Release, vol. 65 Elsevier Science B.V., 2000, pp. 367-374.
Heller, J. et al, "Poly (ortho esters)—their development and some recent applications", European Journal of Pharmaceutics and Biopharmaceutics, vol. 50, Elsevier Science B.V, 2000, pp. 121-138.
Yin, Mao et al, "Synthesis and Properties of Polymers Derived from Substituted Lactic Acids", Chapter 12, American Chemical Society, 2001, pp. 147-159.
Simmons, Tara L. et al, "Poly (phenyliactide): Synthesis, Characterization and Hydrolic Degradation", Biomacromolecules, vol. 2, No. 3, American Chemical Society, 2001, pp. 658-663.
Rothen-Weinhold, A. et al, "Release of BSA from poly (ortho ester) extruded thin strands", Journal of Controlled Release, vol. 71, Elsevier Science B.V., 2001, pp. 31-37.
Schwach-Abdellaoui, K. et al, "Control of Molecular Weight for Auto-Catalyzed Poly) (ortho ester) Obtained by Polycondensation Reaction", International Journal of Polymer Anal. Charart., vol. 7, Taylor & Francis, 2002, pp. 145-161.
Heller, Jorge et al, "Poly (ortho esters): synthesis, characterization, properties and uses", Advanced Drug Delivery Reviews, vol. 54, Elsevier Science B.V. 2002, pp. 1015-1039.
Toncheva, V. et al, "Use of Block Copolymers of Poly (Ortho Esters) and Poly (Ethylene Glycol) Micellar Carriers as Potential Tumour Targeting Systems", Journal of Drug Targeting, vol. 11, No. 6, Taylor & Francis Ltd., 2003, pp. 345-353.
Heller, Jorge et al, "Poly (ortho esters)-From Concept to Reality", Biomacromolecules Reviews, vol. 5, No. 5, American Chemical Society, Sep./Oct. 2004, pp. 1625-1632.
Todd, B. et al, "A Chemical "Trigger" Useful for Oilfield Applications", eLibrary Manuscript Preview Page-Society of Petroleum Engineers, http://www/spe.org/elibinfo/eLibrary_Papers/spec/2005/050CS/00092709/00092709.htm, Nov. 18, 2005, pp. 1-2.
Demo Lab: The Thermite Reaction, "The General Chemistry Demo Lab", http://www.llpi.com/genchem/demo/thermite/index.html, Jun. 7, 2006, pp. 1-5.
Foreign communication from PCT/GB2004/005309 application—International Search Report, Apr. 13, 2005, 4 pgs.
Foreign communication from PCT/GB2004/005309 application—International Preliminary Report on Patentability, Jul. 10, 2006, 8 pgs.
Foreign communication from PCT/GB2004/005309 application—international Search Report and Written Opinion, Jun. 7, 2005, 13 pgs.
Foreign communication from PCT/GB2007/002111—International Search Report and Written Opinion, Sep. 3, 2007, 11 pgs.

* cited by examiner 110
112
114
105
120
127
118
100
125
F

CONSUMABLE DOWNHOLE TOOL

This application is a continuation-in-part of application Ser. No. 12/055,428, filed Mar. 26, 2008 now U.S. Pat. No. 7,726,392.

FIELD OF THE INVENTION

The present invention relates to consumable downhole tools and methods of removing such tools from well bores. More particularly, the present invention relates to downhole tools comprising materials that are burned and/or consumed when exposed to heat and an oxygen source and methods and systems for consuming such downhole tools in situ.

BACKGROUND OF THE INVENTION

A wide variety of downhole tools may be used within a well bore in connection with producing hydrocarbons or reworking a well that extends into a hydrocarbon formation. Downhole tools such as frac plugs, bridge plugs, and packers, for example, may be used to seal a component against casing along the well bore wall or to isolate one pressure zone of the formation from another. Such downhole tools are well known in the art.

After production or reworking is complete, these downhole tools must be removed from the well bore. Tool removal has conventionally been accomplished by complex retrieval operations, or by milling or drilling the tool out of the well bore mechanically. Thus, downhole tools are either retrievable or disposable. Disposable downhole tools have traditionally been formed of drillable metal materials such as cast iron, brass or aluminum. To reduce the milling or drilling time, the next generation of downhole tools comprises composites and other non-metallic materials, such as engineering grade plastics. Nevertheless, milling and drilling continues to be a time consuming and expensive operation. To eliminate the need for milling and drilling, other methods of removing disposable downhole tools have been developed, such as using explosives downhole to fragment the tool, and allowing the debris to fall down into the bottom of the well bore. This method, however, sometimes yields inconsistent results. Therefore, a need exists for disposable downhole tools that are reliably removable without being milled or drilled out, and for methods of removing such disposable downhole tools without tripping a significant quantity of equipment into the well bore.

Furthermore, in oil and gas wells, a drill string is used to drill a well bore into the earth. The drill string is typically a length of drill pipe extending from the surface into the well bore. The bottom end of the drill string has a drill bit.

In order to increase the effectiveness of drilling, weight in the form of one or more drill collars is included in the drill string. A string of drill collars is typically located just above the drill bit and its sub. The string of drill collars contains a number of drill collars. A drill collar is similar to drill pipe in that it has a passage extending from one end to the other for the flow of drilling mud. The drill collar has a wall thickness around the passage; the wall of a drill collar is typically much thicker than the wall of comparable drill pipe. This increased wall thickness enables the drill collar to have a higher weight per foot of length than comparable drill pipe.

During drilling operations, the drill string may become stuck in the hole. If the string cannot be removed, then the drill string is cut. Cutting involves lowering a torch into the drill string and physically severing the drill string in two, wherein the upper part can be removed for reuse in another well bore.

The part of the drill string located below the cut is left in the well bore and typically cannot be retrieved or reused. Cutting is a salvage operation. A particularly effective cutting tool is my radial cutting torch described in U.S. Pat. No. 6,598,679.

The radial cutting torch produces combustion fluids that are directed radially out to the pipe. The combustion fluids are directed out in a complete circumference so as to cut the pipe all around the pipe circumference.

It is desired to cut the drill string as close as possible to the stuck point, in order to salvage as much of the drill string as possible. Cutting the drill string far above the stuck point leaves a section of retrievable pipe in the hole.

If, for example, the drill bit or its sub is stuck, then in theory one of the drill collars can be cut to retrieve at least part of the drill collar string. Unfortunately, cutting a drill collar, with its thick wall, is difficult. It is much easier to cut the thinner wall drill pipe located above the drill collars. Consequently, the drill collar string may be left in the hole, as the drill string is cut above the drill collar.

It is desired to cut a drill collar for retrieval purposes.

SUMMARY OF THE INVENTION

Disclosed herein is a downhole tool having a body or structural component comprising a material that is at least partially consumed when exposed to heat and a source of oxygen. In an embodiment, the material comprises a metal, and the metal may comprise magnesium, such that the magnesium metal is converted to magnesium oxide when exposed to heat and a source of oxygen. The downhole tool may further comprise an enclosure for storing an accelerant. In various embodiments, the downhole tool is a frac plug, a bridge plug, or a packer.

The downhole tool may further comprise a torch with a fuel load that produces the heat and source of oxygen when burned. In various embodiments, the fuel load comprises a flammable, non-explosive solid, or the fuel load comprises thermite. The torch may further comprise a torch body with a plurality of nozzles distributed along its length, and the nozzles may distribute molten plasma produced when the fuel load is burned. In an embodiment, the torch further comprises a firing mechanism with heat source to ignite the fuel load, and the firing mechanism may further comprise a device to activate the heat source. In an embodiment, the firing mechanism is an electronic igniter. The device that activates the heat source may comprise an electronic timer, a mechanical timer, a spring-wound timer, a volume timer, or a measured flow timer, and the timer may be programmable to activate the heat source when the pre-defined conditions are met. The pre-defined conditions comprise elapsed time, temperature, pressure, volume, or any combination thereof. In another embodiment, the device that activates the heat source comprises a pressure-actuated firing head.

DESCRIPTION OF THE PREFERRED EMBODIMENT

Figure 3:
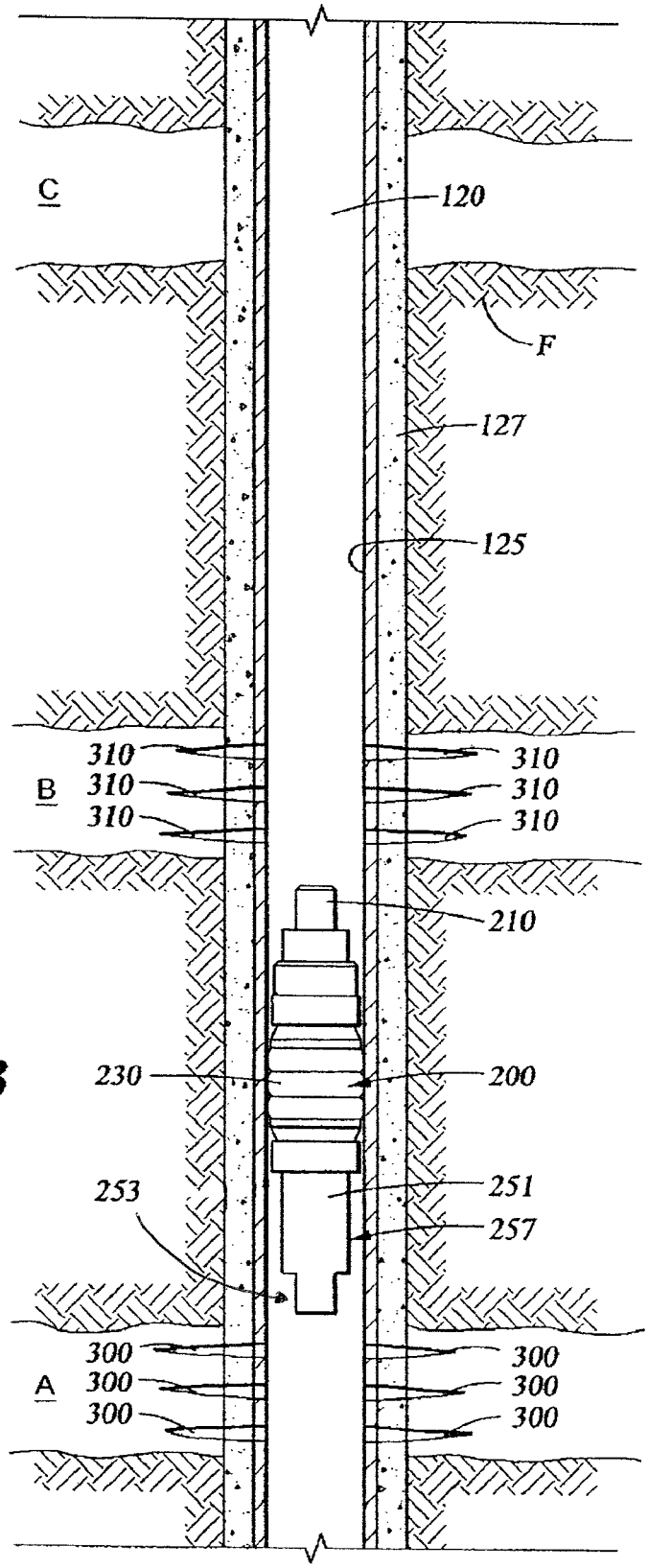
FIG. 3 in an enlarged cross-sectional side view of a well bore with a representative consumable downhole tool with an internal firing mechanism sealed therein.
Figure 4:
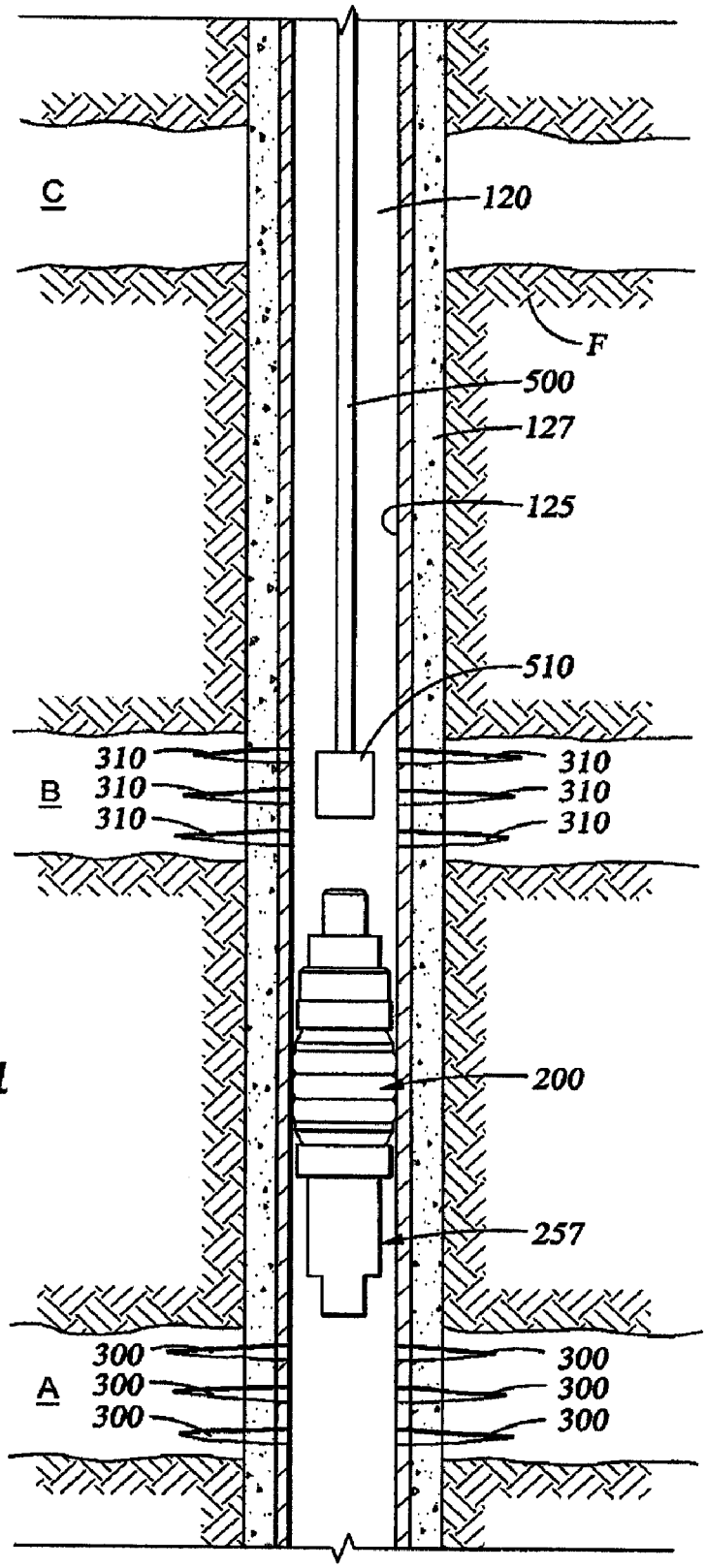
FIG. 4 is an enlarged cross-sectional side view of a well bore with a consumable downhole tool sealed therein, and with a line lowering an alternative firing mechanism towards the tool.
Figure 5:
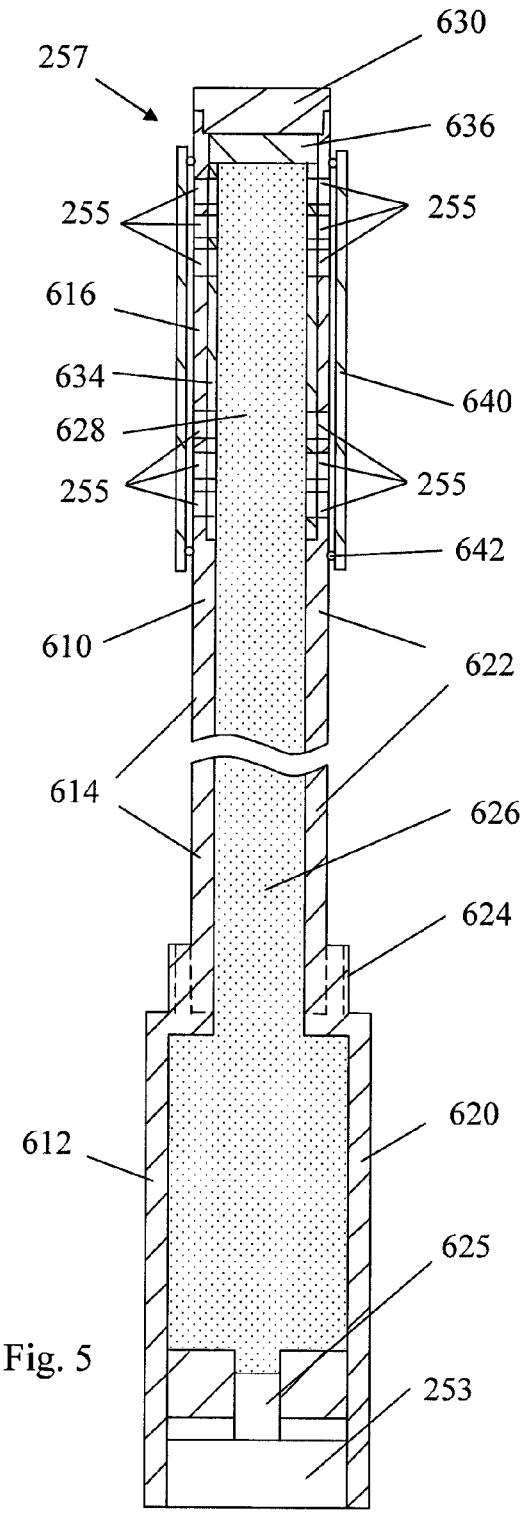
FIG. 5 is a cross-sectional view of the torch, in accordance with a preferred embodiment.
Figure 6:
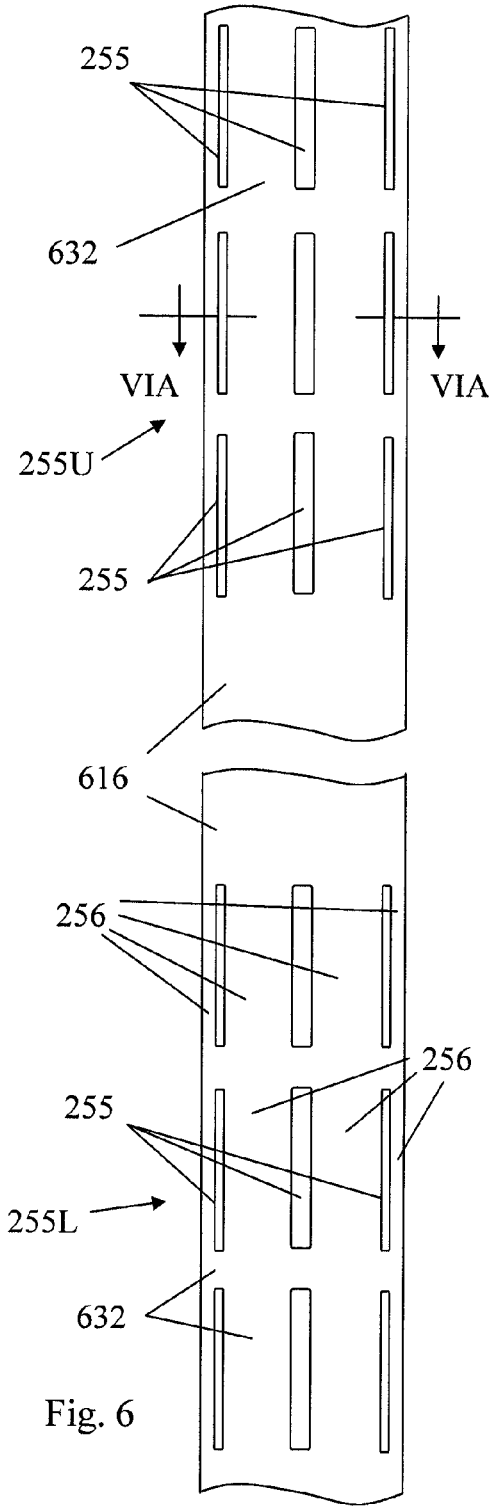
FIG. 6 is a side view of the openings of the torch nozzle.
Figure 6A:
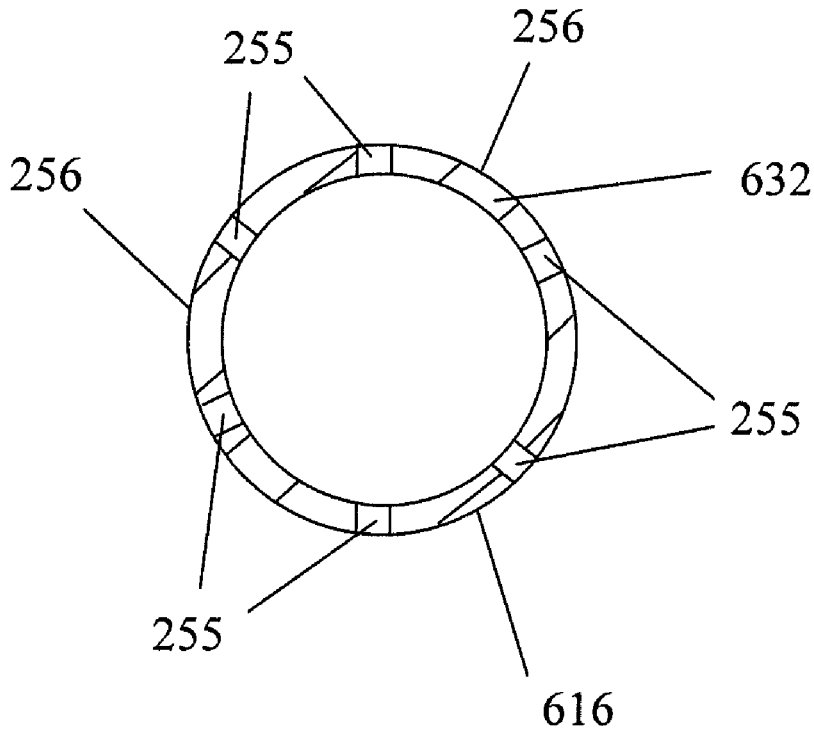
FIG. 6A is a cross-sectional view of the nozzle section of the torch, taken through lines VIA-VIA of FIG. 6.
Figure 7:
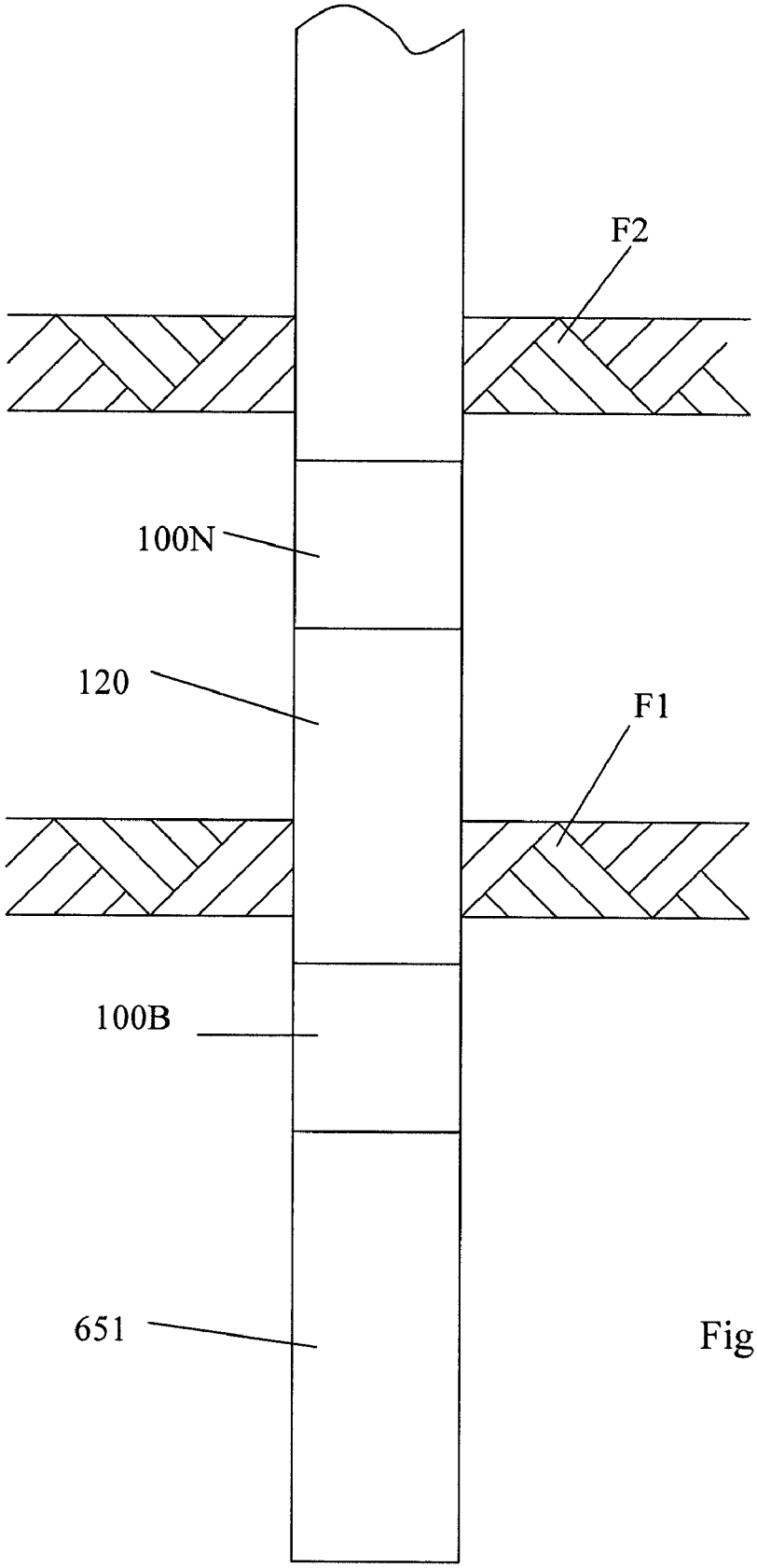
FIG. 7 is a schematic cross-sectional view of a well showing the use of plural isolation tools.

In the description that follows, FIGS. 1-7 will be discussed first. These figures show a downhole tool such as a plug, which tool contains a torch. The torch is used after the plug is no longer needed, to remove the plug from operation. FIGS. 5-7 show the torch in more detail. Then, FIGS. 8-15C will be discussed. These figures show removal of a downhole tool, such as a drill collar, from a borehole using a torch.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", "upwardly" or "upstream" meaning toward the surface of the well and with "down", "lower", "downwardly" or "downstream" meaning toward the lower end of the well, regardless of the well bore orientation. Reference to a body or a structural component refers to components that provide rigidity, load bearing ability and/or structural integrity to a device or tool.

Figure 1:
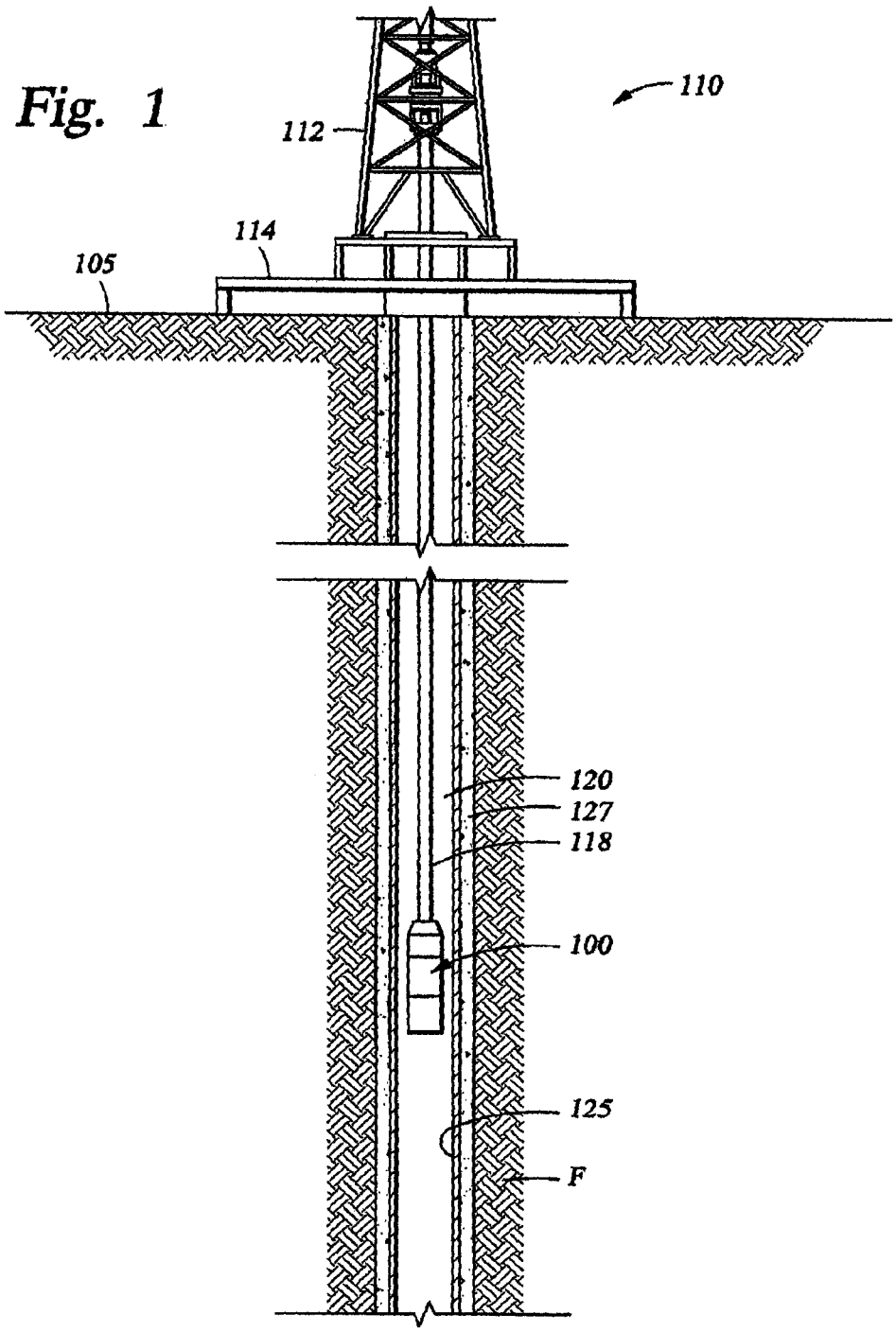
FIG. 1 is a schematic, cross-sectional view of an exemplary operating environment depicting a consumable downhole tool being lowered into a well bore extending into a subterranean hydrocarbon formation.

FIG. 1 schematically depicts an exemplary operating environment for a consumable downhole tool 100. As depicted, a drilling rig 110 is positioned on the earth's surface 105 and extends over and around a well bore 120 that penetrates a subterranean formation F for the purpose of recovering hydrocarbons. At least the upper portion of the well bore 120 may be lined with casing 125 that is cemented 127 into position against the formation F in a conventional manner. The drilling rig 110 includes a derrick 112 with a rig floor 114 through which a work string 118, such as a cable, wireline, E-line, Z-line, jointed pipe, or coiled tubing, for example, extends downwardly from the drilling rig 110 into the well bore 120. The work string 118 suspends a representative consumable downhole tool 100, which may comprise a frac plug, a bridge plug, a packer, or another type of well bore zonal isolation device, for example, as it is being lowered to a predetermined depth within the well bore 120 to perform a specific operation. The drilling rig 110 is conventional and therefore includes a motor driven winch and other associated equipment for extending the work string 118 into the well bore 120 to position the consumable downhole tool 100 at the desired depth.

While the exemplary operating environment depicted in FIG. 1 refers to a stationary drilling rig 110 for lowering and setting the consumable downhole tool 100 within a land-based well bore 120, one of ordinary skill in the art will readily appreciate that mobile workover rigs, well servicing units, such as slick lines and e-lines, and the like, could also be used to lower the tool 100 into the well bore 120. It should be understood that the consumable downhole tool 100 may also be used in other operational environments, such as within an offshore well bore.

Figure 2:
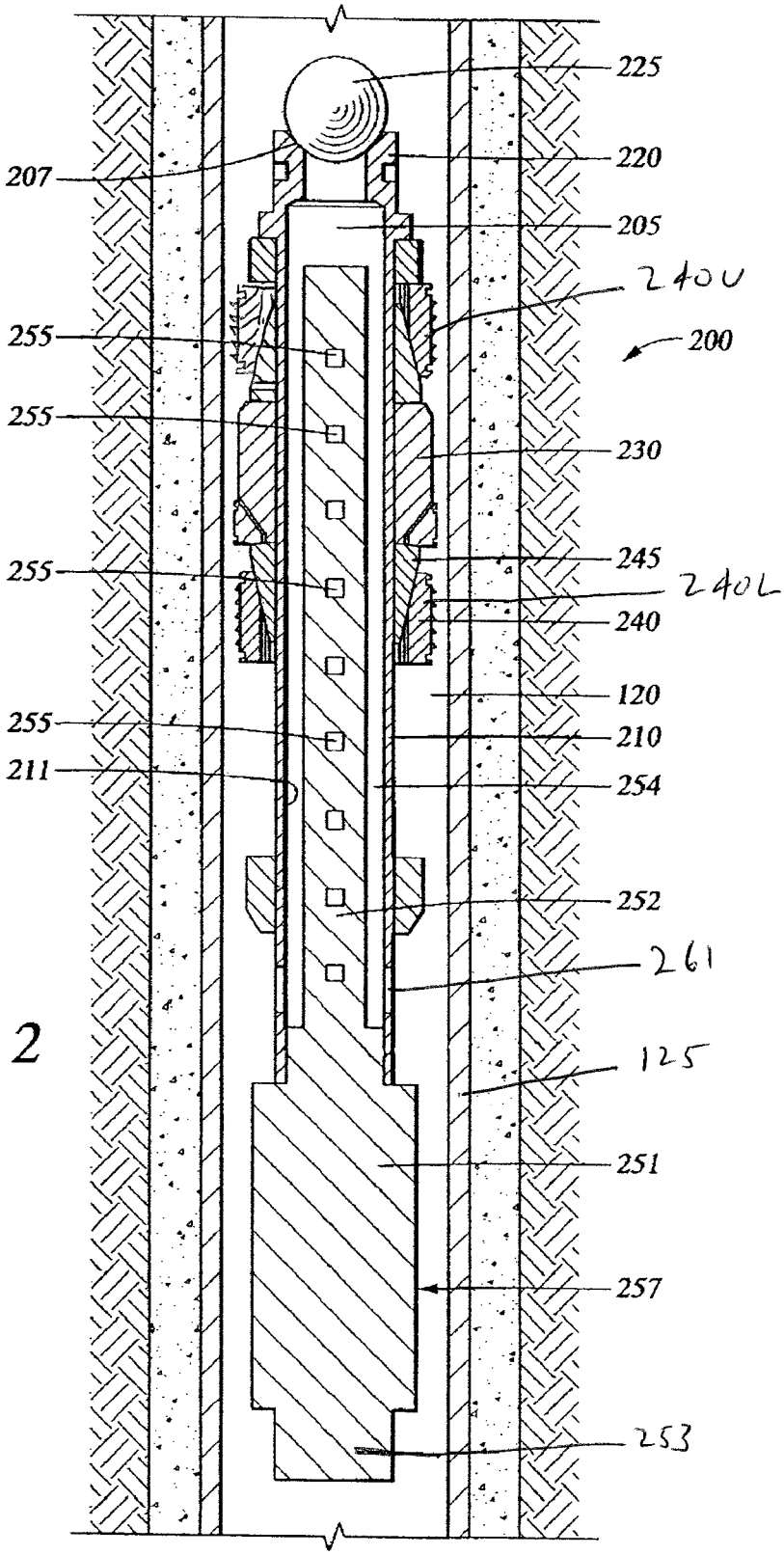
FIG. 2 is an enlarged cross-sectional side view of one embodiment of a consumable downhole tool comprising a frac plug being lowered into a well bore.

The consumable downhole tool 100 may take a variety of different forms. In an embodiment, the tool 100 comprises a plug that is used in a well stimulation/fracturing operation, commonly known as a "frac plug". FIG. 2 depicts an exemplary consumable frac plug, generally designated as 200, as it is being lowered into a well bore 120 on a work string 118 (not shown). The frac plug 200 comprises an elongated tubular body member 210 with an axial flowbore 205 extending therethrough. A ball 225 acts as a one-way check valve. The ball 225, when seated on an upper surface 207 of the flowbore 205, acts to seal off the flowbore 205 and prevent flow downwardly therethrough, but permits flow upwardly through the flowbore 205. In some embodiments, an optional cage, although not included in FIG. 2, may be formed at the upper end of the tubular body member 210 to retain ball 225. A packer element assembly 230 extends around the tubular body member 210. One or more slips 240 are mounted around the body member 210, above and below the packer assembly 230. The slips 240 are guided by mechanical slip bodies 245. A cylindrical torch 257 is shown inserted into the axial flowbore 205 at the lower end of the body member 210 in the frac plug 200. The torch 257 comprises a fuel load 251, a firing mechanism 253, and a torch body 252 with a plurality of nozzles 255 distributed along the length of the torch body 252. The nozzles 255 are angled to direct flow exiting the nozzles 255 towards the inner surface 211 of the tubular body member 210. The firing mechanism 253 is attached near the base of the torch body 252. An annulus 254 is provided between the torch body 252 and the inner surface 211 of the tubular body member 210, and the annulus 254 is enclosed by the ball 225 above and by the fuel load 251 below.

At least some of the components comprising the frac plug 200 may be formed from consumable materials, such as metals, for example, that burn away and/or lose structural integrity when exposed to heat and an oxygen source. Such consumable components may be formed of any consumable material that is suitable for service in a downhole environment and that provides adequate strength to enable proper operation of the frac plug 200. By way of example only, one such material is magnesium metal. In operation, these components may be exposed to heat and oxygen via flow exiting the nozzles 255 of the torch body 252. As such, consumable components nearest these nozzles 255 will burn first, and then the burning extends outwardly to other consumable components.

Any number of combination of frac plug 200 components may be made of consumable materials. In an embodiment, the load bearing components of the frac plug 200, including the tubular body member 210, the slips 240, the mechanical slip bodies 245, or a combination thereof, may comprise consumable material, such as magnesium metal. These load bearing components 210, 240, 245 hold the frac plug 200 in place during well stimulation/fracturing operations. If these components 210, 240, 245 are burned and/or consumed due to exposure to heat and oxygen, they will lose structural integrity and crumble under the weight of the remaining plug 200 components, or when subjected to other well bore forces, thereby causing the frac plug 200 to fall away into the well bore 120. In another embodiment, only the tubular body member 210 is made of consumable material, and consumption of that body member 210 sufficiently comprises the structural integrity of the frac plug 200 to cause it to fall away into the well bore 120 when the frac plug 200 is exposed to heat and oxygen.

The fuel load 251 of the torch 257 may be formed from materials that, when ignited and burned, produce heat and an oxygen source, which in turn may act as the catalysts for initiating burning of the consumable components of the frac plug 200. By way of example only, one material that produces heat and oxygen when burned is thermite, which comprises iron oxide, or rust ($Fe_2O_3$), and aluminum metal powder (Al). When ignited and burned, thermite reacts to produce aluminum oxide ($Al_2O_3$) and liquid iron (Fe), which is a molten plasma-like substance. The chemical reaction is:

$$Fe_2O_3+2Al(s)\rightarrow Al_2O_3(s)+2Fe(l)$$

The nozzles 255 located along the torch body 252 are constructed of carbon and are therefore capable of withstanding the high temperatures of the molten plasma substance without melting. However, when the consumable components of the frac plug 200 are exposed to the molten plasma, the components formed of magnesium metal will react with the oxygen in the aluminum oxide ($Al_2O_3$), causing the magnesium metal to be consumed or converted into magnesium oxide (MgO), as illustrated by the chemical reaction below:

$$3Mg+Al_2O_3\rightarrow 3MgO+2Al$$

When the magnesium metal is converted to magnesium oxide, a slag is produced such that the component no longer has structural integrity and thus cannot carry load. Application of a slight load, such as a pressure fluctuation or pressure pulse, for example, may cause a component made of magnesium oxide slag to crumble. In an embodiment, such loads are applied to the well bore and controlled in such a manner so as to cause structural failure of the frac plug 200.

In one embodiment, the torch 257 may comprise the "Radial Cutting Torch", developed and sold by MCR Oil Tools Corporation. The Radial Cutting Torch includes a fuel load 251 constructed of thermite and classified as a flammable, nonexplosive solid. Using a nonexplosive material like thermite provides several advantages. Numerous federal regulations regarding the safety, handling and transportation of explosive add complexity when conveying explosive to an operational job site. In contrast, thermite is nonexplosive and thus does not fall under these federal constraints. Torches 257 constructed of thermite, including the Radial Cutting Torch, may be transported easily, even by commercial aircraft.

In order to ignite the fuel load 251, a firing mechanism 253 is employed that may be activated in a variety of ways. In one embodiment, a timer, such as an electronic timer, a mechanical timer, or a spring-wound timer, a volume timer, or a measured flow timer, for example, may be used to activate a heating source within the firing mechanism 253. In one embodiment, an electronic timer may activate a heating source when pre-defined conditions, such as time, pressure and/or temperature are met. In another embodiment, the electronic timer may activate the heat source purely as a function of time, such as after several hours or days. In still another embodiment, the electronic timer may activate when predefined temperature and pressure conditions are met, and after a specified time period has elapsed. In an alternate embodiment, the firing mechanism 253 may not employ time at all. Instead, a pressure actuated firing head that is actuated by differential pressure or by a pressure pulse may be used. It is contemplated that other types of devices may also be used. Regardless of the means for activating the firing mechanism 253, once activated, the firing mechanism 253 generates enough heat to ignite the fuel load 251 of the torch 257. In one embodiment, the firing mechanism 253 comprises the "Thermal Generator", developed and sold by MCR Oil Tools Corporation, which utilizes an electronic timer. When the electronic timer senses that pre-defined conditions have been met, such as a specified time has elapsed since setting the timer, a single AA battery activates a heating filament capable of generating enough heat to ignite the fuel load 251, causing it to burn. To accelerate consumption of the frac plug 200, a liquid or powder-based accelerant may be provided inside the annulus 254. In various embodiments, the accelerant may be liquid manganese acetate, nitromethane, or a combination thereof.

In operation, the frac plug 200 of FIG. 2 may be used in a well stimulation/fracturing operation to isolate the zone of the formation F below the plug 200. Referring now to FIG. 3, the frac plug 200 of FIG. 2 is shown disposed between producing zone A and producing zone B in the formation F. As depicted, the frac plug 200 comprises a torch 257 with a fuel load 251 and a firing mechanism 253, and at least one consumable material component such as the tubular body member 210. The slips 240 and the mechanical slip bodies 245 may also be made of consumable material, such as magnesium metal. In a conventional well stimulation/fracturing operation, before setting the frac plug 200 to isolate zone A from zone B, a plurality of perforations 300 are made by a perforating tool (not shown) through the casing 125 and cement 127 to extend into producing zone A. Then a well stimulation fluid is introduced into the well bore 120, such as by lowering a tool (not shown) into the well bore 120 for discharging the fluid at a relatively high pressure or by pumping the fluid directly from the surface 105 into the well bore 120. The well stimulation fluid passes through the perforations 300 into producing zone A of the formation F for stimulating the recovery of fluids in the form of oil and gas containing hydrocarbons. These production fluids pass from zone A, through the perforations 300, and up the well bore 120 for recovery at the surface 105.

Prior to running the frac plug 200 downhole, the firing mechanism 253 is set to activate a heating filament when predefined conditions are met. In various embodiments, such predefined conditions may include a predetermined period of time elapsing, a specific temperature, a specific pressure, or any combination thereof. The amount of time set may depend on the length of time required to perform the well stimulation/fracturing operation. For example, if the operation is estimated to be performed in 12 hours, then a timer may be set to activate the heating filament after 12 hours have lapsed. Once the firing mechanism 253 is set, the frac plug 200 is then lowered by the work string 118 to the desired depth within the well bore 120, and the packer element assembly 230 is set against the casing 125 in a conventional manner, thereby isolating zone A as depicted in FIG. 3. Due to the design of the frac plug 200, the ball 225 will unseal the flowbore 205, such as by unseating from the surface 207 of the flowbore 205, for example, to allow fluid from isolated zone A to flow upwardly through the frac plug 200. However, the ball 225 will seal off the flowbore 205, such as by seating against the surface 207 of the flowbore 205, for example, to prevent flow downwardly into the isolated zone A. Accordingly, the production fluids from zone A continue to pass through the perforations 300, into the well bore 120, and upwardly through the flowbore 205 of the frac plug 200, before flowing into the well bore 120 above the frac plug 200 for recovery at the surface 105.

After the frac plug 200 is set into position as shown in FIG. 3, a second set of perforations 310 may then be formed through the casing 125 and cement 127 adjacent intermediate producing zone B of the formation F. Zone B is then treated with well stimulation fluid, causing the recovered fluids from zone B to pass through the perforations 310 into the well bore 120. In this area of the well bore 120 above the frac plug 200, the recovered fluids from zone B will mix with the recovered fluids from zone A before flowing upwardly within the well bore 120 for recovery at the surface 105.

If additional well stimulation/fracturing operations will be performed, such as recovering hydrocarbons from zone C, additional frac plugs 200 may be installed within the well bore 120 to isolate each zone of the formation F. Each frac plug 200 allows fluid to flow upwardly therethrough from the lowermost zone A to the uppermost zone C of the formation F, but pressurized fluid cannot flow downwardly through the frac plug 200.

After the fluid recovery operations are complete, the frac plug 200 must be removed from the well bore 120. In this context, as stated above, at least some of the components of the frac plug 200 are consumable when exposed to heat and an oxygen source, thereby eliminating the need to mill or drill the frac plug 200 from the well bore 120. Thus, by exposing the frac plug 200 to heat and an oxygen source, at least some of its components will be consumed, causing the frac plug 200 to release from the casing 125, and the unconsumed components of the plug 200 to fall to the bottom of the well bore 120.

In order to expose the consumable components of the frac plug 200 to heat and an oxygen source, the fuel load 251 of the torch 257 may be ignited to burn. Ignition of the fuel load 251 occurs when the firing mechanism 253 powers the heating filament. The heating filament, in turn, produces enough heat to ignite the fuel load 251. Once ignited, the fuel load 251 burns, producing high-pressure molten plasma that is emitted from the nozzles 255 and directed at the inner surface 211 of the tubular body member 210. Through contact of the molten plasma with the inner surface 211, the tubular body member 210 is burned and/or consumed. In an embodiment, the body member 210 comprises magnesium metal that is converted to magnesium oxide through contact with the molten plasma. Any other consumable components, such as the slips 240 and the mechanical slip bodies 245, may be consumed in a similar fashion. Once the structural integrity of the frac plug 200 is compromised due to consumption of its load carrying components, the frac plug 200 falls away into the well bore 120, and in some embodiments, the frac plug 200 may further be pumped out of the well bore 120, if desired.

In the method described above, removal of the frac plug 200 was accomplished without surface intervention. However, surface intervention may occur should the frac plug 200 fail to disengage and, under its own weight, fall away into the well bore 120 after exposure to the molten plasma produced by the burning torch 257. In that event, another tool, such as work string 118, may be run downhole to push against the frac plug 200 until it disengages and falls away into the well bore 120. Alternatively, a load may be applied to the frac plug 200 by pumping fluid or by pumping another tool into the well bore 120, thereby dislodging the frac plug 200 and/or aiding the structural failure thereof.

Surface intervention may also occur in the event that the firing mechanism 253 fails to activate the heat source. Referring now to FIG. 4, in that scenario, an alternate firing mechanism 510 may be tripped into the well bore 120. A slick line 500 or other type of work string may be employed to lower the alternate firing mechanism 510 near the frac plug 200. In an embodiment, using its own internal timer, this alternate firing mechanism 510 may activate to ignite the torch 257 contained within the frac plug 200. In another embodiment, the frac plug 200 may include a fuse running from the upper end of the tubular body member 210, for example, down to the fuel load 251, and the alternate firing mechanism 510 may ignite the fuse, which in turn ignites the torch 257.

In still other embodiments, the torch 257 may be unnecessary. As an alternative, a thermite load may be positioned on top of the frac plug 200 and ignited using a firing mechanism 253. Molten plasma produced by the burning thermite may then burn down through the frac plug 200 until the structural integrity of the plug 200 is compromised and the plug 200 falls away downhole.

Removing a consumable downhole tool 100, such as the frac plug 200 described above, from the well bore 120 is expected to be more cost effective and less time consuming than removing conventional downhole tools, which requires making one or more trips into the well bore 120 with a mill or drill to gradually grind or cut the tool away. The foregoing descriptions of specific embodiments of the consumable downhole tool 100, and the systems and methods for removing the consumable downhole tool 100 from the well bore 120 have been presented for purposes of illustration and description and are not intended to be exhaustive or to limit the invention to the precise forms disclosed. Obviously many other modifications and variations are possible. In particular, the type of consumable downhole tool 100, or the particular components that make up the downhole tool 100 could be varied. For example, instead of a frac plug 200, the consumable downhole tool 100 could comprise a bridge plug, which is designed to seal the well bore 120 and isolate the zones above and below the bridge plug, allowing no fluid communication in either direction, Alternatively, the consumable downhole tool 100 could comprise a packer that includes a shiftable valve such that the packer may perform like a bridge plug to isolate two formation zones, or the shiftable valve may be opened to enable fluid communication therethrough.

In addition to an isolation tool, such as a frac plug, bridge plug or packer, the downhole tool 100 can be drill collars, as discussed more fully below with respect to FIGS. 8-15C.

The plug shown in FIG. 2 has a valve 225 at its upper end. When the valve 225 is closed the flowbore, or cavity, 205 is closed or plugged. The body member, or mandrel, 210 has apertures 261 located at or near the lower end of the body member. When the torch 257 is coupled to the plug 200, the lower end of the body member 210 is closed. The apertures 261 allow flow into and out of the annulus 254 and the axial flowbore 205.

The plug shown in FIG. 2 has retainers, or holding components, in the form of slips 240 and slip bodies 245. When setting the plug, the slips 240 move radially out to engage the wall of the well, which is shown in FIG. 2 as casing 125. Other holding components can be used, such as arms, etc. The mandrel 210 that holds the slips 240 and slip bodies 245 is also a holding component, because structural failure of the mandrel results in the plug 200 releasing from the secured position in the well.

The torch 257 produces a hot plasma, or cutting fluids, that can cut through, dissolve, melt, ignite or otherwise disrupt the structural integrity of a variety of materials. For example, the torch 257 can cut through composite materials. The torch can also cut through metals, such as steel, aluminum and magnesium. When cutting through metals such as steel or aluminum, the cutting fluids melt and erode the metal. Of metals, magnesium has particular attributes that make it useful for fabricating tool component parts. Magnesium is easily machined so that component parts can be fabricated with ease. Also, magnesium has high strength so that component parts will operate under adverse environments such as downhole. Furthermore, magnesium is highly flammable for metals, igniting with relative ease. Once ignited, it will burn, even if submerged. In a downhole environment, the plug or other isolation tool is submerged in well fluids. Thus, a downhole tool having holding components made of magnesium is easier to disable and release, or remove, than the same downhole tool having the same holding components made of non-magnesium materials. The cutting fluids of the torch ignite the magnesium components. Once ignited, the magnesium components combust. When holding components, such as slips 240, are burned away, these components can no longer hold the tool and the tool falls away. Still other materials that can be used are combinations of magnesium and aluminum. Aluminum imparts strength to the part and burns easier than steel, while magnesium burns easier than aluminum.

Still other materials that can be used for the tool, and in particular the components that hold the tool in place in the well, include lead and lead derivatives. Lead can be used as a binder. A component made with lead as a material can be melted or dissolved by the heat of the cutting fluids. Fraccing wells are typically in the temperature range of 150-200° F., which is cool enough not to melt many lead alloys. Thus, lead alloys can be used as structural components of the tool, which components have a relatively low melting point suitable for the torch.

FIGS. 5-7 show the torch 257 in more detail. The torch has an elongated tubular body 610 which body has an ignition section 612, a nozzle section 616 and a fuel section 614 intermediate the ignition and fuel sections. In the preferred embodiment, the tubular body is made of two components coupled together by threads. One component 620 is external to the downhole tool 200 and contains the ignition section 612 and part of the fuel section 614. The external component 620 has a coupling 624, such as threads, which allow the external component to couple to the tool 200. In the embodiment shown in FIG. 2, the external component 620 is coupled to the lower end of the plug body member 210. The other component 622 is received by, and is interior to, the tool 200. The internal component 622 contains the remainder of the fuel section 614 and the nozzle section 616.

The ignition section 612 contains an ignition source 625. In the preferred embodiment, the ignition source is a thermal generator, previously described in my U.S. Pat. No. 6,925,937. The body of the thermal generator is incorporated into the body of the torch. The thermal generator is provided with a battery that provides electrical power for ignition. The firing mechanism 253 is connected to the thermal generator 625 so as to trigger ignition. As previously discussed, the firing mechanism 253 can trigger ignition by the ignition source 625 after a period of time has elapsed, after the temperature downhole has reached a pre-defined or threshold temperature, after the pressure downhole has reached a pre-defined threshold of pressure, etc.

The fuel section 614 contains the fuel 626. The fuel can be made up of a stack of pellets which are donut or toroidal shaped. When stacked, the holes in the center of the pellets are aligned together; these holes are filled with loose fuel. When the fuel combusts, it generates hot combustion fluids that are sufficient to cut through a pipe wall, if properly directed. The combustion fluids comprise gasses and liquids and form cutting fluids.

The fuel 626, 251, is a thermite, or modified thermite, mixture. The mixture includes a powered (or finely divided) metal and a powdered metal oxide. The powdered metal includes aluminum, magnesium, etc. The metal oxide includes cupric oxide, iron oxide, etc. In the preferred embodiment, the thermite mixture is cupric oxide and aluminum. When ignited, the flammable material produces an exothermic reaction. The flammable material has a high ignition point and is thermally conductive. The ignition point of cupric oxide and aluminum is about 1200 degrees Fahrenheit. Thus, to ignite the flammable material, the temperature must be brought up to at least the ignition point and preferably higher. It is believed that the ignition point of some thermite mixtures is as low as 900 degrees Fahrenheit.

The nozzle section 616 has a hollow interior cavity 628. An end plug 630 is located at the free end of the nozzle section, which closes the cavity 628. The cavity 628 contains fuel 626. The fuel 626 extends in a continuous manner from one section to the next 612, 614, 616.

The side wall 632 of the nozzle section 616 has openings 255 (see FIGS. 5-7) that allow communication between the cavity 628 and the exterior of the nozzle section 616. In the preferred embodiment, the openings 255 are slots. Each individual slot 255 extends in a longitudinal direction along the nozzle section. The slots are arranged in rows, with each row of slots being located around the circumference of the nozzle section at a particular longitudinal location. For example, each row has six slots, with the slots spaced sixty degrees apart from one another. The slots are relatively narrow, so as to have interstitial spaces 256 between adjacent slots. In addition, there are several rows of slots. For example, as shown in FIG. 6, there are six rows of slots. The rows are grouped into sets, namely an upper set 255U and a lower set 255L. The upper set 255U is located next to the upper holding components 240U (such as slips, slip bodies, etc.) (see FIG. 2) of the downhole tool, while the lower set 255L is located next to the lower holding components 240L of the downhole tool.

The nozzle section 616 can be made of a material that is able to withstand the heat of the cutting fluids and remain intact long enough to cut the tool 200. For example, the nozzle section can be made of a high carbon steel such as cast iron, can be made of tungsten or can be made of ceramic. Alternatively, the nozzle section can be made of some other material, such as low carbon steel, and is provided with a heat resistant liner 634 and a heat resistant plug 636, which plug is adjacent to the end plug 630. The liner 634 and plug 636 can withstand the temperatures of the ignited fuel and may be carbon based. The outside of the nozzle section 616 receives a sleeve 640, which prevents fluid from entering through the openings 255. O-rings 642 are located around the nozzle section on each side of the openings 255 and provide a seal between the nozzle section 616 and the sleeve 640.

To assemble the tool, the torch 257 is inserted into the plug 200, typically through the bottom end so as not to interfere with any valving or line connection at the upper end. The coupling 624 on the torch is used to connect the torch to the tool. When the torch is fully coupled to the tool, the slots 255 are aligned with and next to the holding components 240, 245 of the tool. The nozzle section 616 is located inside of the tool 200, while the remainder of the torch depends from the lower end of the tool.

The length of the torch depends on the amount of fuel needed. If the cutting requires a relatively large amount of energy, then more fuel is needed. Because the outside diameter of the nozzle section 616 is limited by the inside diameter of the tool, to increase the fuel load, the torch can be lengthened (for example at 251 in FIG. 2) so as to depend further below the tool.

Once the tool 100 is assembled, it can be lowered into the well by the work string 118. Unlike my radial cutting torch in U.S. Pat. No. 6,598,679 and other torches, where the nozzle section is located below or downhole of the fuel section and igniter, this torch 257 is upside down, wherein the nozzle section is located above or uphole of the fuel section and igniter. Nevertheless, the torch works well. The fuel section depends from, or is located below, the nozzle section.

Because the torch 257 extends from the lower end of the plug 200, and because the work string 118 couples to the upper end of the plug, the torch does not interfere with the lowering, placing or operation of the plug in the well. The plug is lowered to its desired location in the well. Once properly located, the plug is manipulated to engage the holding components and secure the tool in position in the well. For example, the slips 240 are manipulated to move along the slips bodies 245 and extend radially out to engage the casing. Engaging the slips also expands the packer element assembly 230, wherein the well is plugged. The plug effectively isolates flow from one formation into another formation along the well. For example, in fraccing, high pressure is developed above the plug 200. The plug prevents fraccing fluids from flowing into formations that are located below the plug. The plug can withstand differential pressures, such as are found in fraccing operations. If pressure below the plug is sufficiently greater than the pressure above the plug, then the valve 225 opens and allows fluid to flow.

Once the formation of interest has been fracced, the plug is no longer needed and can be removed by operating the torch 257.

As discussed above, the torch is initiated by the igniter 253. Suppose, for example, the igniter 253 contains a timer; after an elapsed period of time, the timer causes the igniter 253 to operate. The timer can be started when the tool is lowered into the well, when the tool reaches a threshold or pre-defined pressure (depth), when the tool encounters a threshold of pre-defined temperature, etc. The period of time is selected to allow proper use of the tool, plus some additional time. After the period of time elapsed, the igniter 253 ignites the fuel.

The fuel produces cutting fluids, which cutting fluids exit the torch at the nozzle slots 255. The cutting fluids are directed radially out. Preferably, when the tool was assembled on the surface, the slots 255 were placed adjacent to the holding components 240, 245. One advantage to the nozzle design shown in FIG. 6 is that a single nozzle design and size can be used for a variety of tools. The provision of sets of slots, with each set having a number of rows of slots that extend along a longitudinal distance allows the tool to be used for a variety of spacings between upper and lower holding components. For example, in one tool, the holding components may align with the longitudinal center row of slots in each set, while in another tool, the holding components may align with the longitudinal lower row of slots in each set.

In addition to radial flow of the cutting fluids, there may be some longitudinal flow. For example, as shown in FIG. 2, the upper end of the flow chamber 205 is plugged by a valve 225. The valve 225 is a one-way valve, but the pressure developed by the cutting fluids may be insufficient to overcome the head pressure acting on the valve from above, wherein the valve remains closed. As the cutting fluids flow from the nozzle section, a back pressure will build up above the torch. If the slots in the upper set 255U of nozzles are incorrectly spaced, then the radial flow of cutting fluids exiting these slots will be counter-acted by the back pressure and these slots will in essence be plugged. Plugged slots no longer produce cutting fluids and the holding components located adjacent to the plugged slots will not be cut. However, with the nozzle design of the present invention, the cutting fluids can flow longitudinally through the interstitial spaces 256 between the slots. The radial elements of the cutting fluids are thus spaced sufficiently far apart to create interstitial spaces. These spaces allow longitudinal flow of cutting fluids. Thus, the nozzles in the upper set of slots do not become plugged and continue to produce cutting fluids cutting into the tool. As the longitudinal elements of the cutting fluids flow, these longitudinal elements will cut the mandrel at locations other than at the slips and the slip bodies. Thus, the tool is cut not only at the slips 240, slip bodies 245, but a length of the mandrel 210 is also cut as well. Cutting the slips, slip bodies and a length of the mandrel provides a high reliability in cutting the tool 200. The apertures 261 near the lower end of the tool serve as vent ports and prevent back pressure at the lower end of the nozzle section. The result is the tool is released and falls to the bottom of the well.

Frequently a well has more than one formation of interest. As shown in FIG. 7, a typical well may have between 2-12 formations F1, F2, etc., which formations are fracced one at a time and separately from each other. When fraccing in a well with plural formations, the work begins with the bottommost formation and proceeds uphole one formation at a time. For example, the bottom formation is fracced first. Next, the second to bottom formation is fracced, and so on. A frac plug is placed or set in the well below the formation that is to be fracced.

The well has a rat hole 651, which is the length of well that extends below the bottommost formation F1. During completion operations, such as fraccing, the rate hole may fill up, particularly in a well with many formations. The rat hole can fill with sand from fraccing operations and from the isolation tools that have been released and allowed to drop to the bottom of the well. When the rat hole fills up, the casing perforations of the bottommost formation F1 may become plugged, wherein production from this bottommost formation is interrupted. Fishing debris from the bottom of the well adds to the overall cost of the well and may not be successful.

To prevent the rat hole from filling up, a bottommost isolation tool 100B, such as a frac plug is set above the rat hole, which tool is equipped with a torch 257. The isolation tool 100B may be used to frac the bottommost formation. After the bottommost formation is fracced, the other formations are fracced or otherwise completed; the isolation tool 100B is left in place above the rat hole. Thus, the well may have two or more isolation tools 100B, 100N in place at any given time.

In the prior art, using two or more isolation tools in a well at the same time is seen as creating problems because the isolation tools have to be removed by drilling out each tool. The uppermost tool 100N, once released, falls on top of lower tool 100B, thereby blocking access to the lower tool 100B and making releasing the lower tool difficult if not impossible.

With the present invention, the bottommost isolation tool 100B is left in place covering the rat hole 651 until all of the formations F1, F2, etc. are fracced or otherwise completed. Any sand that is above the bottommost tool 100B can be removed by production fluids from the formations. The torch 257 is then used to release the bottommost tool, wherein the tool debris is allowed to fall to the bottom of the well. Because the sand has been removed, the debris falling into the rat hole is less in quantity than it would otherwise be. Thus, the rat hole is less likely to fill up, thereby preserving the production of the bottommost formation. The torch timer is set to ignite for a period of time that is the total time of fraccing operations in the well plus some additional time, such as an extra day or week. When the period of time elapses, the torch ignites and the bottommost torch is released and allowed to fall, along with any debris from other released tools that may be on top of the bottommost tool.

Turning now to drill collars, the present invention cuts a drill collar 11 (see FIGS. 8 and 11) in a well 12, thereby enabling the retrieval and future reuse of some or most of the drill collar string. The present invention utilizes a cutting torch 15 lowered down inside of the drill string 17. A torch is positioned at one of the joints 21 of one of the drill collars. The joints are high torque couplings.

When the torch 15 is ignited (see FIG. 9), it produces combustion fluids 81. The combustion fluids form a longitudinal slice or cut 23 through the coupling 21. This is different than conventional cutting techniques that cut a pipe all around its circumference. The longitudinal cut effectively splits the coupling (see FIGS. 10 and 12). Because the coupling is under high torque before being cut, after being cut it unwinds and decouples. Thus, a relatively small amount of cutting energy can effectively cut a thick walled drill collar 11. The portion of the drill collar string that is decoupled is retrieved.

The present invention will be discussed now in more detail. First, a drill collar 11 will be discussed, followed by a description of the torch 15 and then the cutting operation will be discussed.

Figure 8:
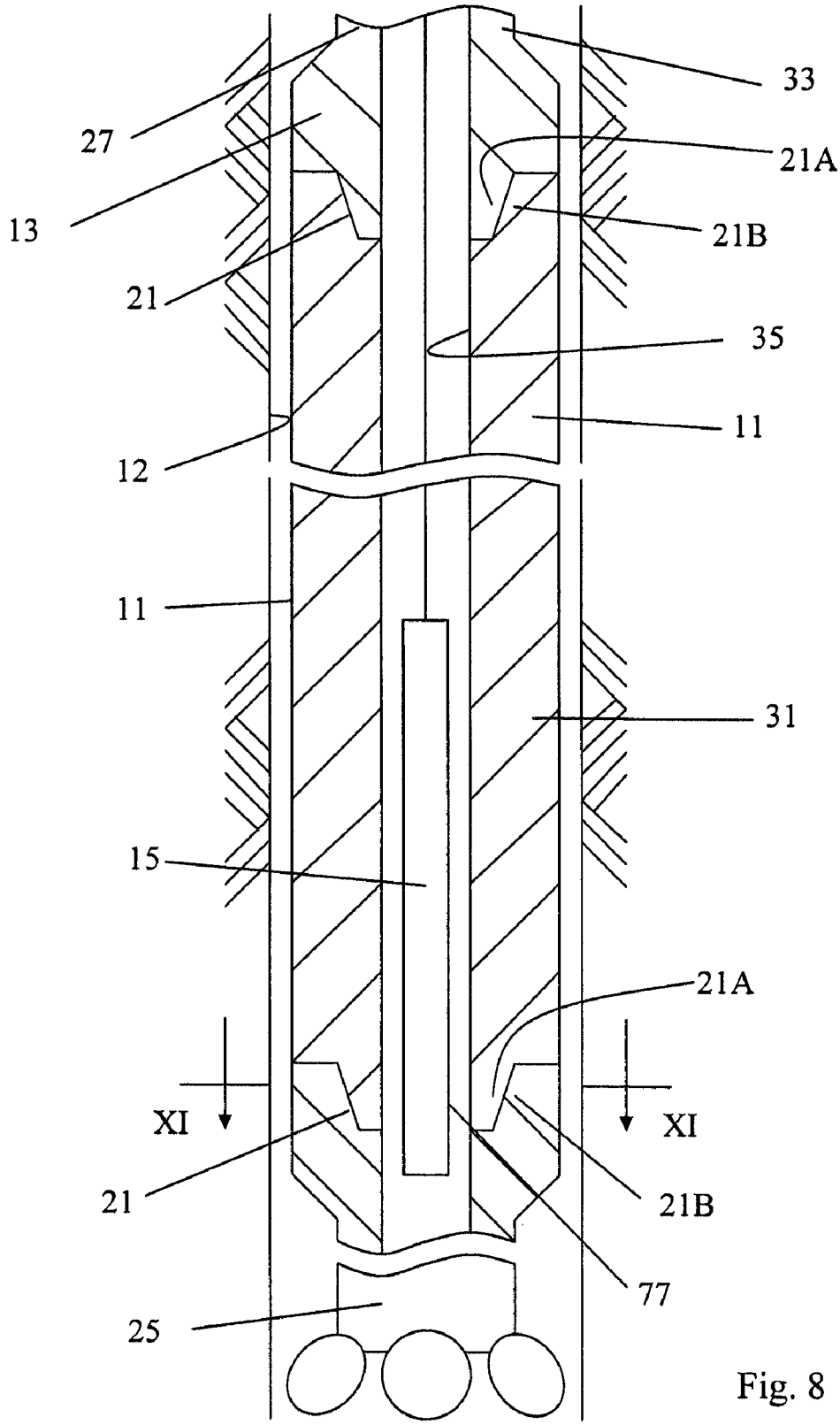
FIG. 8 is a cross-sectional view of a borehole with an uncut drill collar and a torch.
Figure 9:
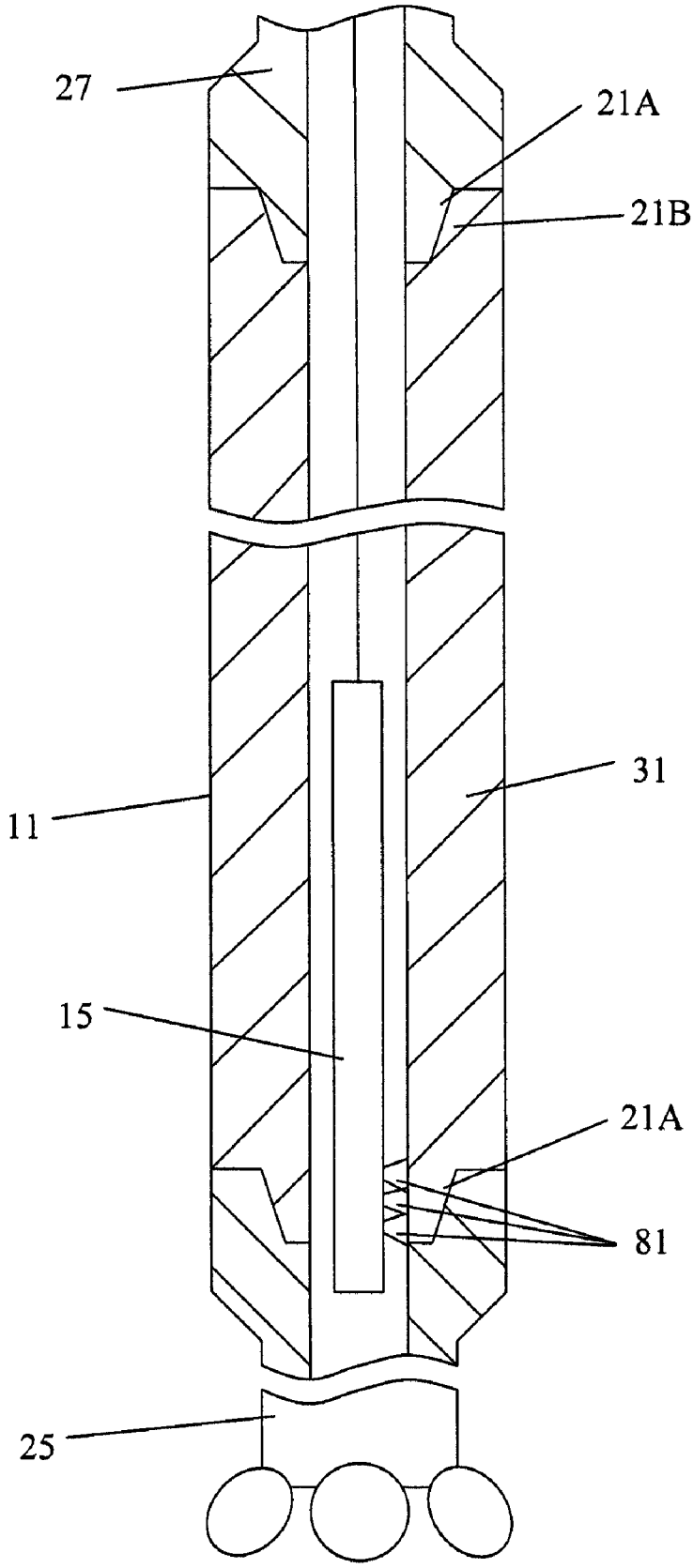
FIG. 9 is the same as FIG. 8, but the torch has been ignited.

Referring to FIG. 8, the drill collar 11 is part of a drill string 13 that is located in a well 12 or borehole. The drill string 13 typically has a bottom hole assembly made up of a drill bit 25 and its sub and one or more drill collars 11. There may be other components such as logging while drilling (LWD) tools, measuring while drilling (MWD) tools and mud motors. Drill pipe 27 extends from the bottom hole assembly up to the surface. The drill string may have transition pipe, in the form of heavy weight drill pipe between the drill collars and the drill pipe. The drill string forms a long pipe, through which fluids, such as drilling mud, can flow.

The various components of the drill string are coupled together by joints. Each component or length of pipe has a coupling or joint at each end. Typically, a pin joint is provided at the bottom end, which has a male component, while a box joint is provided at the upper end, which has a female component. For example, as shown in FIG. 8, the lower joint of a drill collar 11 is a pin joint 21A, while the upper joint 21B is a box joint.

As illustrated in FIG. 8, the drill collar 11 is a heavy or thick walled pipe. The thickness of the drill collar wall 31 is greater than the thickness of the drill pipe wall 33. A passage 35 extends along the length of the drill collar, between the two ends.

The wall thickness of the pin joint 21A is less than the thickness of the wall 31 of the drill collar portion that is located between the two ends. Typical dimensions of the pin joint are 4 inches in length and ½ to 1 inch in wall thickness. The pin joint is tapered to fit into the similarly tapered box joint 21B.

The joints or couplings in the drill string and particularly in the drill collars are tight due to drilling. During drilling, the drill string 13 is rotated. This rotation serves to tighten any loose couplings. Consequently, the joints are under high torque.

Figure 13:
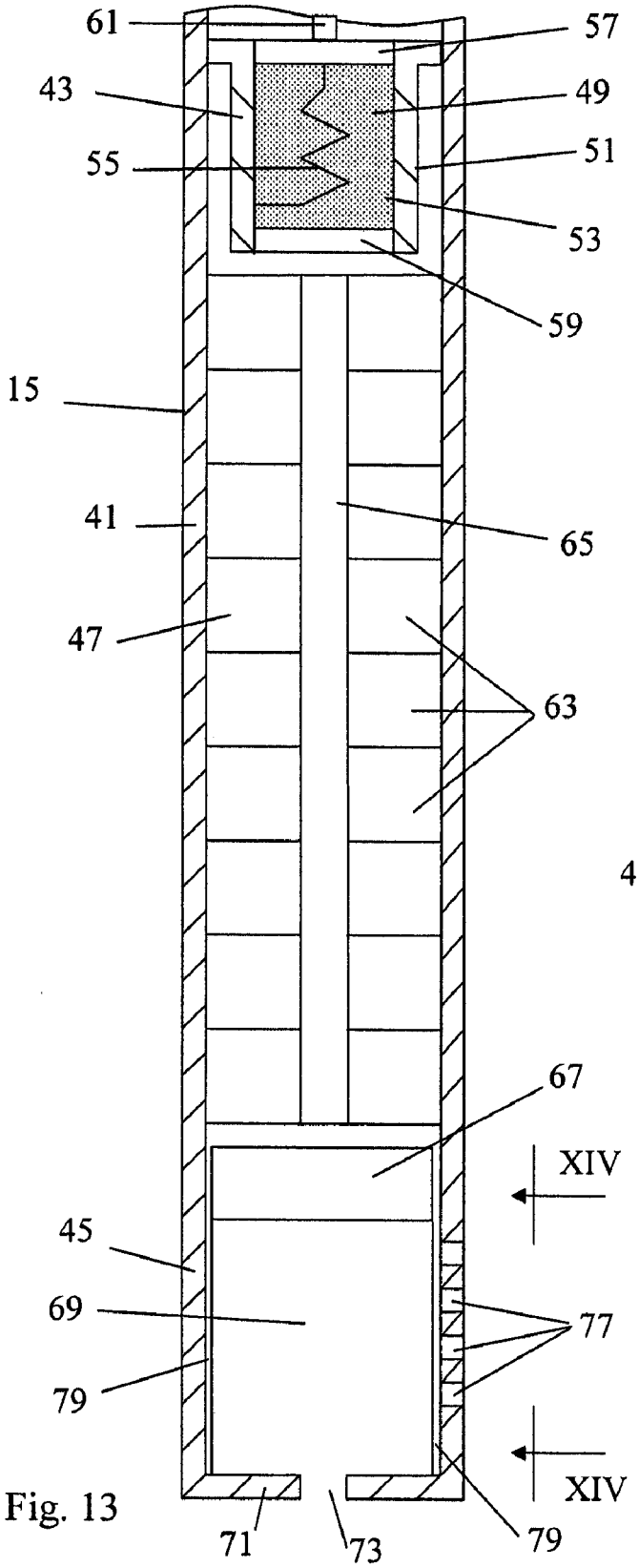
FIG. 13 is a longitudinal cross-sectional view of the torch.
Figure 14:
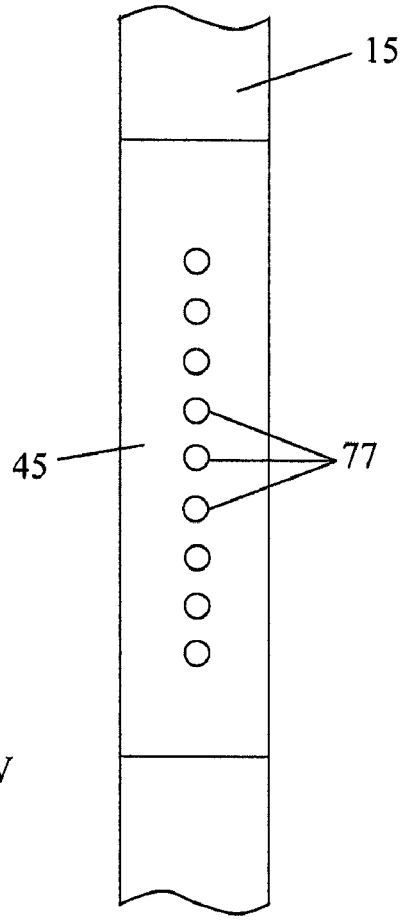
FIG. 14 is a side elevational view of the nozzle pattern of the torch, taken along lines XIV-XIV of FIG. 13.

The cutting torch 15 is shown in FIG. 13. The torch 15 has an elongated tubular body 41 which body has an ignition section 43, a nozzle section 45 and a fuel section 47 intermediate the ignition and fuel sections. In the preferred embodiment, the tubular body is made of three components coupled together by threads. Thus, the fuel section 47 is made from an elongated tube or body member, the ignition section 43 is made from a shorter extension member and the nozzle section 45 is made from a shorter head member.

The ignition section 43 contains an ignition source 49. In the preferred embodiment, the ignition source 49 is a thermal generator, previously described in my U.S. Pat. No. 6,925,937. The thermal generator 49 is a self-contained unit that can be inserted into the extension member. The thermal generator 49 has a body 51, flammable material 53 and a resistor 55. The ends of the tubular body 51 are closed with an upper end plug 57, and a lower end plug 59. The flammable material 53 is located in the body between the end plugs. The upper end plug 57 has an electrical plug 61 or contact that connects to an electrical cable (not shown). The upper plug 57 is electrically insulated from the body 51. The resistor 55 is connected between the contact 61 and the body 51.

The flammable material 53 is a thermite, or modified thermite, mixture. The mixture includes a powered (or finely divided) metal and a powdered metal oxide. The powdered metal includes aluminum, magnesium, etc. The metal oxide includes cupric oxide, iron oxide, etc. In the preferred embodiment, the thermite mixture is cupric oxide and aluminum. When ignited, the flammable material produces an exothermic reaction. The flammable material has a high ignition point and is thermally conductive. The ignition point of cupric oxide and aluminum is about 1200 degrees Fahrenheit. Thus, to ignite the flammable material, the temperature must be brought up to at least the ignition point and preferably higher. It is believed that the ignition point of some thermite mixtures is as low as 900 degrees Fahrenheit.

The fuel section 47 contains the fuel. In the preferred embodiment, the fuel is made up of a stack of pellets 63 which are donut or toroidal shaped. The pellets are made of a combustible pyrotechnic material. When stacked, the holes in the center of the pellets are aligned together; these holes are filled with loose combustible material 65, which may be of the same material as the pellets. When the combustible material combusts, it generates hot combustion fluids that are sufficient to cut through a pipe wall, if properly directed. The combustion fluids comprise gasses and liquids and form cutting fluids.

The pellets 65 are adjacent to and abut a piston 67 at the lower end of the fuel section 47. The piston 67 can move into the nozzle section 45.

The nozzle section 45 has a hollow interior cavity 69. An end plug 71 is located opposite of the piston 67. The end plug 71 has a passage 73 therethrough to the exterior of the tool. The side wall in the nozzle section 45 has one or more openings 77 that allow communication between the interior and exterior of the nozzle section. The nozzle section 45 has a carbon sleeve 79 liner, which protects the tubular metal body. The liner 75 is perforated at the openings 77.

The openings are arranged so as to direct the combustion fluids in a longitudinal manner. In the embodiment shown in FIG. 14, the openings 77 are arranged in a vertical alignment. The openings 77 can be rectangular in shape, having a height greater than a width. Alternatively, the openings can be square or circular (as shown). In another embodiment, the nozzle section 45 can have a single, elongated, vertical, slot-type opening.

The piston 67 initially is located so as to isolate the fuel 63 from the openings 77. However, under the pressure of combustion fluids generated by the ignited fuel 63, the piston 67 moves into the nozzle section 45 and exposes the openings 77 to the combustion fluids. This allows the hot combustion fluids to exit the tool through the openings 77.

The method will now be described. Referring to FIG. 8, the torch 15 is lowered into the drill string 13, which drill string is stuck. Before the torch is lowered, the decision has been made to cut the drill string and salvage as much of the drill string as possible. Also, the drill string is stuck at a point along the drill collar string or below the drill collar string.

The torch 15 can be lowered on a wireline, such as an electric wireline. The torch is positioned inside of the drill collar 11 which is to be cut. Specifically, the openings 77 are located at the same depth of the pin coupling 21A which is to be cut. The length of the arrangement of openings is longer than the pin joint. The longer the arrangement of openings, the less precision is required when positioning the torch relative to the pin joint 21A. Then, the torch is ignited. An electrical signal is provided to the igniter 49 (see FIG. 13), which ignites the fuel 65, 63. The ignited fuel produces hot combustion fluids. The combustion fluids 81 produced by the fuel force the piston 67 down and expose the openings 77. The combustion fluids 81 are directed out of the openings 77 and into the pin coupling 21A (see FIG. 9). The combustion fluids are directed in a pattern that is longitudinal, rather than circumferential. The combustion fluid pattern is at least as long as the pin joint, and in practice extends both above and below the pin joint.

Figure 10:
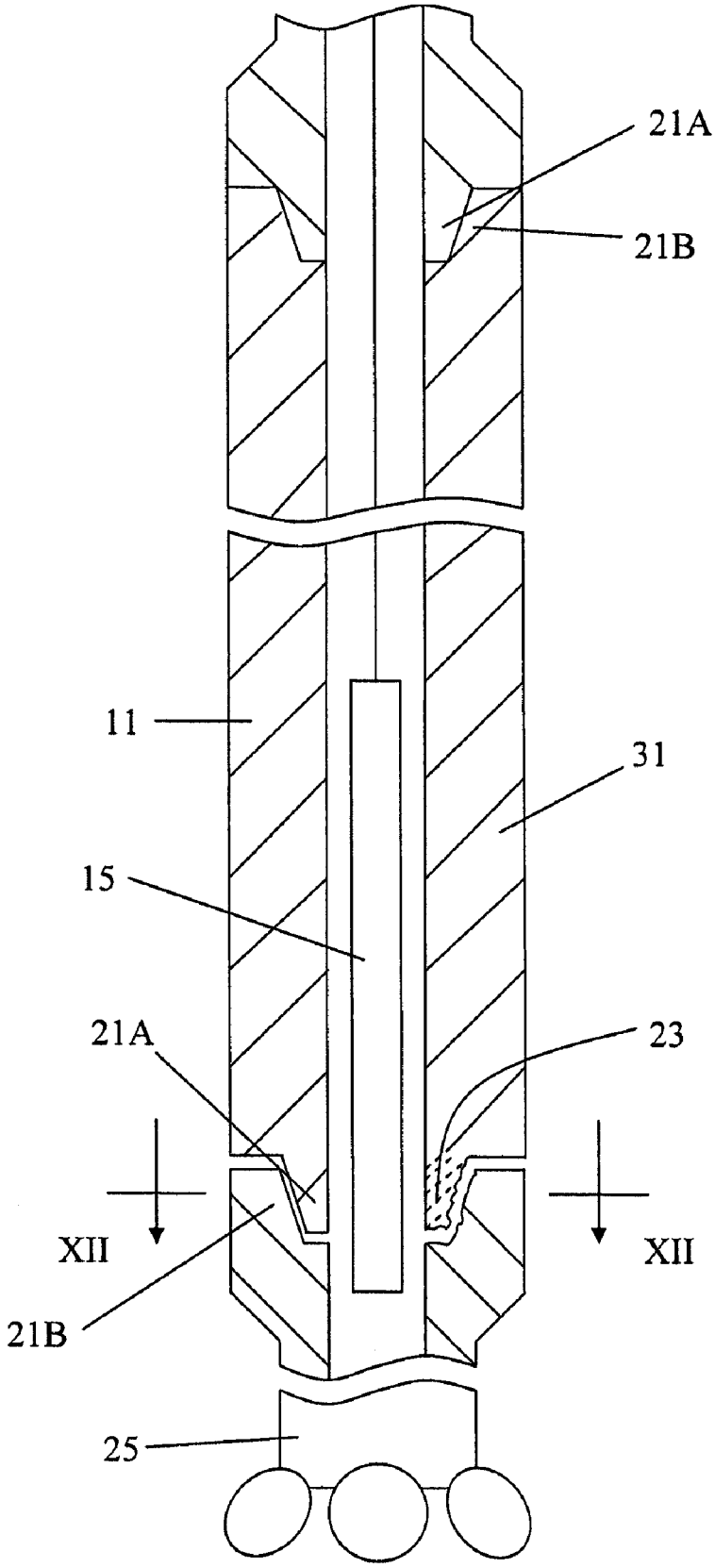
FIG. 10 shows the drill collar of FIG. 8, having been cut and separated.
Figure 11:
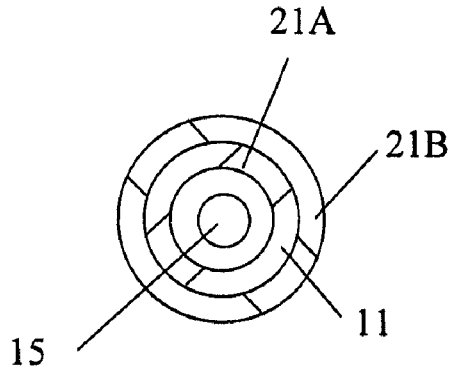
FIG. 11 is a cross-sectional view of FIG. 8, taken along lines XI-XI.
Figure 12:
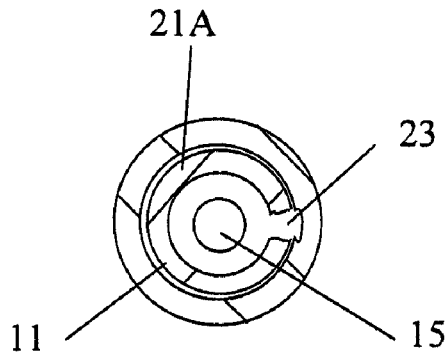
FIG. 12 is a cross-sectional view of FIG. 10, taken along lines XII-XII.

The torch creates a cut 23 along the longitudinal axis in the pin joint 21A (see FIGS. 10 and 12). The pin 21A is severed. The portions of drill collar above and below the pin joint have longitudinal cuts therein, but due to the wall thickness, these cuts do not extend all the way to the outside. FIG. 12 shows the cut extending part way into the corresponding box joint. Thus, the box joint and the portions of the drill collar above and below the pin joint are not cut completely through and are unsevered. Nevertheless, when the pin joint is cut, it unwinds or springs open. The joint decouples and the drill string becomes severed at the joint. Thus, only the pin joint need be cut to sever the drill collar. That portion of the drill string that is unstuck, the upper portion, is retrieved to the surface.

Figure 15A:
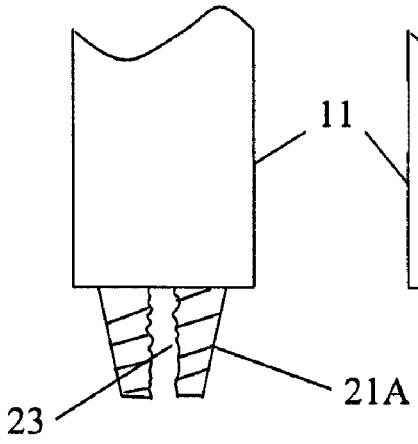
FIGS. 15A-15C show the dressing of a cut end of a drill collar to form a new pin joint.
Figure 15B:
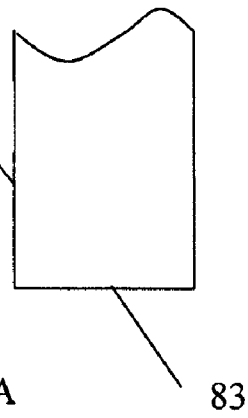
Figure 15C:
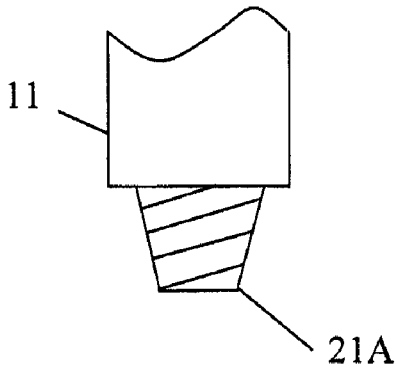

The drill collar 11 that was cut at its pin joint can be reused. Referring to FIG. 15A, the pin joint 21A has a longitudinal cut 23 therein. The pin joint 21A is cut off of the drill collar, as well as any damaged portions of the collar to form a clean end 83 (see FIG. 15B). The end 83 is remachined to form a new pin joint (see FIG. 15C). The drill collar can now be reused.

Each of the torches can be provided with ancillary equipment such as an isolation sub and a pressure balance anchor. The isolation sub typically is located on the upper end of the torch and protects tools located above the torch from the cutting fluids. Certain well conditions can cause the cutting fluids, which can be molten plasma, to move upward in the tubing and damage subs, sinker bars, collar locators and other tools attached to the torch. The isolation sub serves as a check valve to prevent the cutting fluids from entering the tool string above the torch.

The pressure balance anchor is typically located below the torch and serves to stabilize the torch during cutting operations. The torch has a tendency to move uphole due to the forces of the cutting fluids. The pressure balance anchor prevents such uphole movement and centralizes the torch within the tubing. The pressure balance anchor has either mechanical bow spring type centralizers or rubber finger type centralizers.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, the scope including all equivalents of the subject matter of the claims.

The invention claimed is:

1. A system for consuming a downhole material comprising:

A torch apparatus disposed within a cased region of a borehole, wherein the torch apparatus comprises:

a torch body comprising a fuel load that produces heat and a source of oxygen when burned; and a nozzle section engaged with the torch body configured with a plurality of slots to allow longitudinal flow of fluid along the torch body without interfering with the flow of fluid through the slots, and wherein the orientation of the nozzle section directs the heat and the source of oxygen toward a material disposed proximate to the torch apparatus that is at least partially consumed when exposed to heat and the source of oxygen.

2. The torch apparatus of claim 1, wherein the torch apparatus is configured to direct cutting fluids into a joint of a downhole tubestring.

3. The torch apparatus of claim 2, wherein the downhole tubestring further comprises a drill collar string.

4. The torch apparatus of claim 2, wherein the joint comprises a pin component engaged with a box component.

5. The torch apparatus of claim 1, the nozzle section further comprising a movable piston, wherein cutting fluids are produced from the torch apparatus upon movement of the piston.

6. The torch apparatus of claim 1, wherein the nozzle section is disposed within a cavity defined within the material.

7. The torch apparatus of claim 1, wherein the plurality of slots extend in a longitudinal direction and are arranged around a circumference of the nozzle section.

8. The torch apparatus of claim 1, wherein the plurality of slots further comprise a first set of slots having at least two rows of slots spaced longitudinally from one another and a second set of slots having at least two rows of slots spaced longitudinally from one another, wherein the first set of slots and the second set of slots are longitudinally spaced from each other.

9. The torch apparatus of claim 1, wherein the nozzle section is oriented such that heat and the source of oxygen are directed toward a body, structural component, or holding component formed at least partially from the material to perforate at least a portion of the body, structural component, or holding component.

10. The torch apparatus of claim 9, wherein the body, structural component, or holding component is formed at least partially from a material other than the material that is at least partially consumed when exposed to heat and the source of oxygen.

11. The torch apparatus of claim 1, wherein the material comprises a metal that is consumed when exposed to heat and the source of oxygen.

12. The torch apparatus of claim 11, wherein the metal is magnesium, and wherein the magnesium is oxidized when exposed to heat and the source of oxygen.

13. The torch apparatus of claim 11, wherein the metal is lead, and wherein the lead is melted, dissolved, or combinations thereof, when exposed to heat and the source of oxygen.

14. The torch apparatus of claim 1, wherein the fuel load comprises a flammable, non-explosive solid that produces heat and the source of oxygen when burned.

15. The torch apparatus of claim 1, wherein the fuel load comprises thermite.

16. The torch apparatus of claim 1, wherein the fuel load produces molten plasma when burned, and wherein the molten plasma is provided through the slots to the material.

17. The torch apparatus of claim 1, further comprising a firing mechanism with a heat source in communication with the fuel load for igniting the fuel load.

18. The torch apparatus of claim 17, wherein the firing mechanism is an electronic igniter.

19. The torch apparatus of claim 17, wherein the firing mechanism further comprises a timing device for causing ignition of the fuel load after a preselected elapsed time.

20. The torch apparatus of claim 19, wherein the timing device is programmable to activate the heat source when pre-defined conditions are met.

21. The torch apparatus of claim 20, wherein the firing mechanism comprises an electronic timer, a mechanical timer, a spring-wound timer, a volume timer, or a measured flow timer.

22. The torch apparatus of claim 21, wherein the pre-defined conditions comprise elapsed time, temperature, pressure, volume, or any combination thereof.

23. The torch apparatus of claim 17, wherein the firing mechanism further comprises a pressure actuated firing head.

24. The torch apparatus of claim 1, further comprising an enclosure for storing an accelerant.

25. The torch apparatus of claim 1, wherein the nozzle section is disposed within a cavity defined within the material.

26. The torch apparatus of claim 25, wherein an annular flow space is defined between the nozzle section and the material.

27. The torch apparatus of claim 1, wherein at least one slot of the plurality of slots comprises an elongate orifice that extends in a longitudinal direction and wherein the plurality of slots are arranged around a circumference of the nozzle section.

28. The torch apparatus of claim 1, wherein the torch apparatus comprises an upper end and a lower end, and wherein the fuel load is located at the lower end.

29. The torch apparatus of claim 1, wherein the nozzle section is disposed upstream of the fuel load.

* * * * *